US010631386B1

(12) United States Patent
McRae

(10) Patent No.: US 10,631,386 B1
(45) Date of Patent: Apr. 21, 2020

(54) MULTI-COLOR FLAT ROPE LIGHT STRING SYSTEM

(71) Applicant: National Tree Company, Cranford, NJ (US)

(72) Inventor: Michael M. McRae, Ormond Beach, FL (US)

(73) Assignee: National Christmas Products LLC, Cranford, NJ (US)

( * ) Notice: Subject to any disclaimer, the term of this patent is extended or adjusted under 35 U.S.C. 154(b) by 0 days.

(21) Appl. No.: 16/588,537

(22) Filed: Sep. 30, 2019

(51) Int. Cl.

| | |
|---|---|
| ***H05B 33/08*** | (2020.01) |
| ***H05B 45/20*** | (2020.01) |
| ***F21V 23/00*** | (2015.01) |
| ***F21S 4/10*** | (2016.01) |
| ***F21V 23/06*** | (2006.01) |
| ***F21V 15/01*** | (2006.01) |
| ***F21V 23/04*** | (2006.01) |
| ***H05B 45/37*** | (2020.01) |
| *F21Y 103/10* | (2016.01) |
| *F21Y 113/13* | (2016.01) |
| *F21Y 115/10* | (2016.01) |

(52) U.S. Cl.
CPC ..... *H05B 45/20* (2020.01); *F21S 4/10* (2016.01); *F21V 15/01* (2013.01); *F21V 23/003* (2013.01); *F21V 23/04* (2013.01); *F21V 23/06* (2013.01); *H05B 45/37* (2020.01); *F21Y 2103/10* (2016.08); *F21Y 2113/13* (2016.08); *F21Y 2115/10* (2016.08)

(58) Field of Classification Search
CPC ..... H05B 33/0815; H05B 33/0827; H05B 33/0845; H05B 33/0863
USPC ..... 315/192, 193
See application file for complete search history.

(56) References Cited

U.S. PATENT DOCUMENTS

| | | | | |
|---|---|---|---|---|
| 10,408,393 | B2 * | 9/2019 | Zhao | H05B 47/185 |
| 2010/0141161 | A1 * | 6/2010 | Hering | H05B 33/0821 315/185 S |
| 2015/0085508 | A1 * | 3/2015 | McConathy | B62J 6/003 362/473 |
| 2015/0362164 | A1 * | 12/2015 | Levante | H05B 33/0845 315/201 |
| 2019/0090330 | A1 * | 3/2019 | Aykroyd | H05B 33/0809 |

* cited by examiner

*Primary Examiner* — Tung X Le
(74) *Attorney, Agent, or Firm* — Ellenoff Grossman & Schole LLP; James M. Smedley; Alex Korona

(57) ABSTRACT

Apparatus and associated methods are provided for a flat rope light string system arranged to provide a plurality of holiday displays. The apparatus comprising a controller coupled to a power source at a first connection and at least one light string at a second connection, the second connection including at least one connection lead, the at least one light string including a plurality of lighting elements, each of the lighting elements comprising a plurality of bulb housings, each bulb housing including at least one pair of LEDs arranged in a back-to-back configuration. The controller having a switch with a plurality of switch positions to provide the plurality of holiday displays.

18 Claims, 19 Drawing Sheets

COLOR ASSIGNMENT/ PAIRINGS

| ROW | LED IDENTIFIER | BULB IDENTIFIER | BULB COLOR | COLOR PAIRINGS |
|---|---|---|---|---|
| 1 | A | BULB1 | WHITE | WHITE/RED |
| 2 | B | BULB1 | RED | |
| 3 | C | BULB2 | WHITE | WHITE/GREEN |
| 4 | D | BULB2 | GREEN | |
| 5 | E | BULB3 | WHITE | WHITE/YELLOW |
| 6 | F | BULB3 | YELLOW | |
| 7 | G | BULB4 | WHITE | WHITE/BLUE |
| 8 | H | BULB4 | BLUE | |

FIG. 1E

COLOR OUTPUT

| ROW | CONTROLLER SWITCH POSITION | OUTPUT LEADS ENERGIZED AND DC POLARITY | RESULTING ILLUMINATION | EVENT/ HOLIDAY |
|---|---|---|---|---|
| 1 | FIRST SWITCH POSITION | OUTPUT LEAD 131-FIRST DC PHASE (+) LEAD 133-COMMON RETURN | LED "A" =WHITE<br>LED "C" =WHITE<br>LED "E" =WHITE<br>LED "G" =WHITE | EVERYDAY, CHRISTMAS |
| 2 | SECOND SWITCH POSITION | OUTPUT LEAD 131-SECOND DC PHASE(-) LEAD 133-COMMON RETURN | LED "B" =RED<br>LED "D" =GREEN<br>LED "F" =YELLOW<br>LED "H" =BLUE | CHRISTMAS |
| 3 | THIRD SWITCH POSITION | ALT 120 Hz BETWEEN<br>OUTPUT LEAD 131-FIRST DC PHASE(+)<br>&<br>OUTPUT LEAD 131-SECOND DC PHASE(-)<br>LEAD 131- COMMON REUTRN | LED (C&D)= ALT (WHITE & GREEN= LIGHT GREEN ILLUMINATION<br>LEDS (E&F) =ALT (WHITE & YELLOW = LIGHT YELLOW ILLUMINATION<br>LEDS (G&H =ALT (WHITE & BLUE = LIGHT BLUE ILLUMINATION | EASTER |

FIG. 1F

COLOR ASSISGNMENTS/ PAIRINGS

| ROW | LED IDENTIFIER | SET IDENTIFIER | BULB IDENTIFIER | BULB COLOR | COLOR PAIRINGS |
|---|---|---|---|---|---|
| 1 | A | 231-A | BULB 1 | ORANGE | ORANGE/ WHITE |
| 2 | B | 231-A | BULB 1 | WHITE | |
| 3 | C | 231-A | BULB 2 | GREEN | GREEN/ BLUE |
| 4 | D | 231-A | BULB 2 | BLUE | |
| 5 | E | 231-A | BULB 3 | PURPLE | PURPLE/ RED |
| 6 | F | 231-A | BULB 3 | RED | |
| | | | | | |
| 7 | A | 231-B | BULB 1 | ORANGE | ORANGE/ WHITE |
| 8 | B | 231-B | BULB 1 | WHITE | |
| 9 | C | 231-B | BULB 2 | GREEN | GREEN/ BLUE |
| 10 | D | 231-B | BULB 2 | BLUE | |
| 11 | E | 231-B | BULB 3 | PURPLE | PURPLE/ RED |
| 12 | F | 231-B | BULB 3 | RED | |
| | | | | | |
| 13 | A | 231-C | BULB 1 | ORANGE | ORANGE/ WHITE |
| 14 | B | 231-C | BULB 1 | WHITE | |
| 15 | C | 231-C | BULB 2 | GREEN | GREEN/ BLUE |
| 16 | D | 231-C | BULB 2 | BLUE | |
| 17 | E | 231-C | BULB 3 | PURPLE | PURPLE/ RED |
| 18 | F | 231-C | BULB 3 | RED | |
| | | | | | |
| 19 | A | 231-D | BULB 1 | ORANGE | ORANGE/ WHITE |
| 20 | B | 231-D | BULB 1 | WHITE | |
| 21 | C | 231-D | BULB 2 | GREEN | GREEN/ BLUE |
| 22 | D | 231-D | BULB 2 | BLUE | |
| 23 | E | 231-D | BULB 3 | PURPLE | PURPLE/ RED |
| 24 | F | 231-D | BULB 3 | RED | |
| | | | | | |
| 25 | A | 231-E | BULB 1 | ORANGE | ORANGE/ WHITE |
| 26 | B | 231-E | BULB 1 | WHITE | |
| 27 | C | 231-E | BULB 2 | GREEN | GREEN/ BLUE |
| 28 | D | 231-E | BULB 2 | BLUE | |
| 29 | E | 231-E | BULB 3 | PURPLE | PURPLE/ RED |
| 30 | F | 231-E | BULB 3 | RED | |

FIG. 2D

COLOR ASSISGNMENTS/ PAIRINGS

| ROW | LED IDENTIFIER | SET IDENTIFIER | BULB IDENTIFIER | BULB COLOR | COLOR PAIRINGS |
|---|---|---|---|---|---|
| 31 | A | 231-F | BULB 1 | ORANGE | ORANGE/ WHITE |
| 32 | B | 231-F | BULB 1 | WHITE | |
| 33 | C | 231-F | BULB 2 | GREEN | GREEN/ BLUE |
| 34 | D | 231-F | BULB 2 | BLUE | |
| 35 | E | 231-F | BULB 3 | PURPLE | PURPLE/ RED |
| 36 | F | 231-F | BULB 3 | RED | |
| | | | | | |
| 37 | A | 231-G | BULB 1 | ORANGE | ORANGE/ WHITE |
| 38 | B | 231-G | BULB 1 | WHITE | |
| 39 | C | 231-G | BULB 2 | GREEN | GREEN/ BLUE |
| 40 | D | 231-G | BULB 2 | BLUE | |
| 41 | E | 231-G | BULB 3 | PURPLE | PURPLE/ RED |
| 42 | F | 231-G | BULB 3 | RED | |
| | | | | | |
| 43 | A | 231-H | BULB 1 | ORANGE | ORANGE/ WHITE |
| 44 | B | 231-H | BULB 1 | WHITE | |
| 45 | C | 231-H | BULB 2 | GREEN | GREEN/ BLUE |
| 46 | D | 231-H | BULB 2 | BLUE | |
| 47 | E | 231-H | BULB 3 | PURPLE | PURPLE/ RED |
| 48 | F | 231-H | BULB 3 | RED | |

FIG. 2D (CONTINUED)

COLOR OUTPUT

| ROW | CONTROLLER SWITCH POSITION | OUTPUT LEADS ENERGIZED AND DC PHASE | RESULTING ILLUMINATION | HOLIDAY |
|---|---|---|---|---|
| 1 | FIRST SWITCH DC PHASE (+) | OUTPUT LEAD #236 POSITIVE DC POLARITY (+) | ORANGE | CHRISTMAS |
| 2 | SECOND SWITCH POSITION | OUTPUT LEAD #236 NEGATIVE DC POLARITY (-) | WHITE | EVERYDAY,CHRISTMAS |
| 3 | THIRD SWITCH POSITION | OUTPUT LEAD #234 POSITIVE POLARITY (+) | GREEN | CHRISTMAS |
| 4 | FOURTH SWITCH POSITION | OUTPUT LEAD #234 NEGATIVE DC POLARITY (-) | BLUE | CHRISTMAS |
| 5 | FIFTH SWITCH POSITION | OUTPUT LEAD #235 POSITIVE DC POLARITY (+) | PURPLE | CHRISTMAS |
| 6 | SIXTH SWITCH POSITION | OUTPUT LEAD #235 NEGATIVE DC POLARITY (-) | RED | CHRISTMAS |
| 7 | SEVENTH SWITCH POSITION | OUTPUT LEADS 236, #234, #235 ALL NEGATIVE DC POLARITY (-) | RED, WHITE, BLUE | UNITED STATES NATIONAL HOLIDAYS |
| 8 | EIGHTH SWITCH POSITION | OUTPUT LEADS , #235, #236 ALL POSITIVE DC POLARITY (+) | ORANGE, PURPLE | MARDI GRAF/ HALLOWEEN |

FIG. 2E

| ROW | CONTROLLER SWITCH POSITION | OUTPUT LEADS ENERGIZED AND DC POLARITY | RESULTING ILLUMINATION | HOLIDAY |
|---|---|---|---|---|
| 9 | NINTH SWITCH POSITION | OUTPUT #236(-) AND 235 (-) | RED, WHITE | CHRISTMAS, VALENTINE |
| 10 | TENTH SWITCH POSITION | ALTERNATING - LEAD 236, NEGATIVE DC POLARITY WITH LEAD 234, POSITIVE DC POLARITY - ALTERNATING EACH LEAD TO BE ON FOR 1 SECOND | WHITE, GREEN | CHRISTMAS, ST. PATS |
| 11 | ELEVENTH SWITCH POSITION | LEADS #236(-),#234(+),#235(-) | WHITE, GREEN, RED | CHRISTMAS, ITALIAN, MEXICAN NATIONAL HOLIDAYS |
| 12 | TWELFTH SWITCH POSITION | ALTERNATING (LEAD 236, (POSITIVE DC POLARITY), (LEAD 234, (POSITIVE DC POLARITY), (LEAD 235, (NEGATIVE DC POLARITY), (LEAD 234, (NEGATIVE DC POLARITY), | ORANGE, GREEN, RED, BLUE | CHRISTMAS |

FIG. 2E (CONTINUED)

COLOR ASSIGNMENT/ PAIRINGS

| ROW | LED IDENTIFIER | BULB COLOR | COLOR PAIRINGS |
|---|---|---|---|
| 1 | A | WHITE | WHITE/ YELLOW |
| 2 | B | YELLOW | |
| 3 | C | ORANGE | ORANGE/ WHITE |
| 4 | D | WHITE | |
| 5 | E | WHITE | WHITE/ BLUE |
| 6 | F | BLUE | |
| 7 | G | PURPLE | PURPLE/ RED |
| 8 | H | RED | |
| 9 | I | WHITE | WHITE/ RED |
| 10 | J | RED | |
| 11 | K | GREEN | GREEN/ WHITE |
| 12 | L | WHITE | |
| 13 | M | WHITE | WHITE/ GREEN |
| 14 | N | GREEN | |
| 15 | O | PURPLE | PURPLE/ WHITE |
| 16 | P | BLUE | |

COLOR OUTPUT

| ROW | CONTROLLER SWITCH POSITION | OUTPUT LEADS ENERGIZED AND DC PASE | RESULTING ILLUMUNATION | EVENT/ HOLIDAY |
|---|---|---|---|---|
| 1 | FIRST SWITCH POSITION | OUTPUT LEAD #324 POSITIVE DC POLARITY (+) | LED "A" = WHITE<br>LED "E" = WHITE<br>LED "I" = WHITE<br>LED "M" = WHITE | EVERYDAY, CHRISTMAS |
| 2 | SECOND SWITCH POSITION | OUTPUT LEAD #324 POSITIVE DC POLARITY (+) | LED "B" = YELLOW<br>LED "F" = BLUE<br>LED "J" = RED<br>LED "N" = GREEN | CHRISTMAS |
| 3 | THIRD SWITCH POSITION | OUTPUT LEAD #322 POSITIVE DC POLARITY (+) | LED "C" = ORANGE<br>LED "G" = PURPLE<br>LED "K" = GREEN<br>LED "0" = PURPLE | HALLOWEEN, MARDI GRAS |
| 4 | FOURTH SWITCH POSITION | OUTPUT LEAD #322 POSITIVE DC POLARITY (+) | LED "D" = WHITE<br>LED "H" = RED<br>LED "L" = WHITE<br>LED "P" = BLUE | NATIONAL HOLIDAYS, EVENTS |
| 5 | FIFTH SWITCH POSITION | ALT 120 Hz OUTPUT LEAD #324 POSITIVE DC POLARITY (+) &OUTPUT LEAD #324 NEGATIVE DC POLARITY (-) | PASTELS - LT YELLOW, LT - BLUE, PINK, LT - GREEN | EASTER |
| 6 | SIXTH SWITCH POSITION | ALT 120 HZ OUTPUT LEAD #324 POSITIVE DC ENEGRY (+) AND OUTPUT LEAD #324 (-) ALT < 60 Hz FLASH | WHITE/ MUTLICOLOR OR ( YELLOW, BLUE, RED, GREEN | CHRISTMAS |

FIG. 3D

COLOR ASSIGNMENT/ PAIRINGS

| ROW | LED IDENTIFIER | SET IDENTIFIER | BULB COLOR | BULB PAIRINGS |
|---|---|---|---|---|
| 1 | A | 431-A | WHITE | WHITE/ RED |
| 2 | B | 431-A | RED | |
| 3 | C | 431-A | WHITE | WHITE/ RED |
| 4 | D | 431-A | RED | |
| 5 | E | 431-A | PURPLE | PURPLE/ RED |
| 6 | F | 431-A | RED | |
| 7 | G | 431-A | RED | RED/ GREEN |
| 8 | H | 431-A | GREEN | |
| | | | | |
| 9 | A | 431-B | WHITE | WHITE/ GREEN |
| 10 | B | 431-B | GREEN | |
| 11 | C | 431-B | GREEN | GREEN/ WHITE |
| 12 | D | 431-B | WHITE | |
| 13 | E | 431-B | ORANGE | ORANGE/ WHITE |
| 14 | F | 431-B | WHITE | |
| 15 | G | 431-B | WHITE | WHITE/ RED |
| 16 | H | 431-B | RED | |
| | | | | |
| 17 | A | 431-C | WHITE | WHITE/ YELLOW |
| 18 | B | 431-C | YELLOW | |
| 19 | C | 431-C | WHITE | WHITE/ GREEN |
| 20 | D | 431-C | GREEN | |
| 21 | E | 431-C | PURPLE | PURPLE/ RED |
| 22 | F | 431-C | RED | |
| 23 | G | 431-C | BLUE | BLUE/ GREEN |
| 24 | H | 431-C | GREEN | |
| | | | | |
| 25 | A | 431-D | WHITE | WHITE/ BLUE |
| 26 | B | 431-D | BLUE | |
| 27 | C | 431-D | GREEN | GREEN/ WHITE |
| 28 | D | 431-D | WHITE | |
| 29 | E | 431-D | GREEN | GREEN/ WHITE |
| 30 | F | 431-D | WHITE | |
| 31 | G | 431-D | WHITE | WHITE/ RED |
| 32 | H | 431-D | RED | |

FIG. 4D

COLOR ASSIGNMENT/ PAIRINGS

| ROW | LED IDENTIFIER | SET IDENTIFIER | BULB COLOR | BULB PAIRINGS |
|---|---|---|---|---|
| 33 | A | 431-E | WHITE | WHITE/ RED |
| 34 | B | 431-E | RED | |
| 35 | C | 431-E | WHITE | WHITE/ RED |
| 36 | D | 431-E | RED | |
| 37 | E | 431-E | PURPLE | PURPLE/ RED |
| 38 | F | 431-E | RED | |
| 39 | G | 431-E | RED | RED/ GREEN |
| 40 | H | 431-E | GREEN | |
| | | | | |
| 41 | A | 431-F | WHITE | WHITE/ GREEN |
| 42 | B | 431-F | GREEN | |
| 43 | C | 431-F | GREEN | GREEN/ WHITE |
| 44 | D | 431-F | WHITE | |
| 45 | E | 431-F | ORANGE | ORANGE/ WHITE |
| 46 | F | 431-F | WHITE | |
| 47 | G | 431-F | WHITE | WHITE/ RED |
| 48 | H | 431-F | RED | |
| | | | | |
| 49 | A | 431-G | WHITE | WHITE/ YELLOW |
| 50 | B | 431-G | YELLOW | |
| 51 | C | 431-G | WHITE | WHITE/ GREEN |
| 52 | D | 431-G | GREEN | |
| 53 | E | 431-G | PURPLE | PURPLE/ RED |
| 54 | F | 431-G | RED | |
| 55 | G | 431-G | BLUE | BLUE/ GREEN |
| 56 | H | 431-G | GREEN | |
| | | | | |
| 57 | A | 431-H | WHITE | WHITE/ BLUE |
| 58 | B | 431-H | BLUE | |
| 59 | C | 431-H | GREEN | GREEN/ WHITE |
| 60 | D | 431-H | WHITE | |
| 61 | E | 431-H | GREEN | GREEN/ WHITE |
| 62 | F | 431-H | WHITE | |
| 63 | G | 431-H | WHITE | WHITE/ RED |
| 64 | H | 431-H | RED | |

FIG. 4D
(CONTINUED)

COLOR OUTPUT

| ROW | CONTROLLER SWITCH POSITION | OUTPUT LEADS ENERGIZED AND DC POLARITY | RESULTING ILLUMUNATION | EVENT/ HOLIDAY |
|---|---|---|---|---|
| 1 | FIRST SWITCH POSITION | OUTPUT LEAD #413 POSITIVE DC POLARITY (+) | WHITE | EVERYDAY/ CHRISTMAS |
| 2 | SECOND SWITCH POSITION | OUTPUT LEAD #413 NEGATIVE DC POLARITY (-) | RED, GREEN, YELLOW, BLUE | CHRISTMAS |
| 3 | THIRD SWITCH POSITION | OUTPUT LEAD #411 POSITIVE DC POLARITY (+) | WHITE, GREEN | CHRISTMAS/ ST.PATS |
| 4 | FOURTH SWITCH POSITION | OUTPUT LEAD #411 NEGATIVE DC POLARITY (-) | RED, WHITE, GREEN, WHITE | CHRISTMAS/ ITALIAN/ MEXICAN/ HOLIDAY |
| 5 | FIFTH SWITCH POSITION | OUTPUT LEAD #409 POSITIVE DC POLARITY (+) | PURPLE, ORANGE, PURPLE, GREEN | MARDI/ GRAS |
| 6 | SIXTH SWITCH POSITION | OUTPUT LEAD #409 NEGATIVE DC POLARITY (-) | RED, WHITE, RED, WHITE | CHRISTMAS/ VALENTINES DAY |
| 7 | SEVENTH SWITCH POSITION | OUTPUT LEAD #407 POSITIVE DC POLARITY(+) | RED,WHITE, BLUE | U.S. |
| 8 | EIGHTH SWITCH POSITION | OUTPUT LEAD #407 NEGATIVE DC POLARITY (-) | GREEN/ RED | CHRISTMAS |
| 9 | NINTH SWITCH POSITION | OUTPUT LEAD #413 ALT 120HZ BETWEEN POSITIVE DC (+) NEGATIVE DC POLARITY (+) | PINK, LT - BLUE, LT - GREEN, LT - YELLOW, BLUE | EASTER |

FIG. 4E

MULTI-COLOR FLAT ROPE LIGHT STRING SYSTEM

TECHNICAL FIELD

The present invention relates generally to a flat rope light string system and more particularly to a flat rope light string system employing light emitting diodes (LEDs).

BACKGROUND

Light emitting diodes (LEDs) are increasingly employed as a basic lighting source in a variety of forms, including decorative lighting, for reasons among the following. First, as a device, LEDs have a very long lifespan, compared with common incandescent and fluorescent sources, with typical LED lifespan at least 100,000 hours. Second, LEDs have several favorable physical properties, including ruggedness, cool operation, and ability to operate under wide temperature variations. Third, LEDs are currently available in all primary and several secondary colors, as well as in a "white" form employing a blue source and phosphors. Fourth, with newer doping techniques, LEDs are becoming increasingly efficient, and colored LED sources currently available may consume an order of magnitude less power than incandescent bulbs of equivalent light output. Moreover, with expanding applications and resulting larger volume demand, as well as with new manufacturing techniques, LEDs are increasingly cost effective.

Various LED light strings have been proposed for decorative illumination purposes. Most LED light sets and rope lights, including flat rope lights come with a variety of lighting options. Most are rotating color combinations or have the ability to change colors as desired, within a limit. Those LED light sets where colors can be programmed or selected by the user, have the entire set change to any one color at a time. One example of this is commonly referred to as a dual colored light string. This type of LED light string takes advantage of the fact that LEDs only illuminate when a voltage is applied in the correct direction. By coupling two LEDs together in parallel, anode to cathode and cathode to anode, so that only one of the LEDs will light with each voltage polarity, a dual color light string can be created. This type of light string may emit white light when a positive voltage is applied and multi-colored light when a negative voltage is applied. While multiple variations of this kind of dual-polarity LED light string are known, such LED light strings are not capable of placing different combinations of LEDs on the light string in specific locations to be energized in a forward and reverse bias as selected by a controller.

Exemplary LED-based light strings are described in the literature which employ purely parallel wiring of discrete LED lamps using a step-down transformer and rectifier power conversion scheme. The LED light string descriptions found in the prior art convert input electrical power, usually assumed to be the common U.S. household power of 110 VAC to a low voltage, nearly DC input.

Thus, conventional LED light string controllers are lacking in certain aspects. In particular, none of the prior art LED light string controllers disclose an LED light string that includes different combinations of LEDs on a light string in specific locations, under control of a controller that can easily and conveniently select a plurality of LED light display patterns that correspond to pre-arranged lighting color schemes applicable to holidays and other events.

Conventional flat rope systems lack in one additional aspect. Namely, these conventional systems utilize three LEDs in parallel where all of the LEDs change to the same color at the same time and do not have the capability to dynamically change the display pattern over in accordance with pre-programmed event patterns.

SUMMARY OF THE INVENTION

Embodiments of the present invention provide a unique multi-color light emitting diode (LED) flat rope light string system including a controller for coordinating the illumination of the different multi-colored LED lights in accordance with a series of selectable color displays via a switching mechanism. The multi-colored LED lights being selected at a time of manufacture and contained within a single light string in pairs or among several interconnected LED light strings. The flat rope light string system uniquely providing a capability for realizing a plurality of different holiday patterns not available heretofore in conventional light string systems. Capabilities are provided to allow a customer, at a time of manufacture, to select the location and color for different multi-colored LEDs in the bulb housings of the flat rope light string system of the invention. A customer may also select, at a time of manufacture, which LEDs are to be energized such that the flat rope light string system illuminates specific illumination patterns representing a specific desired holiday, special event, sports team or display. The customer specific set of selected multi-colored LEDs along with the customer specific selectable patterns can be conveniently printed on the box display at the time of manufacture. That is, the invention uniquely provides customers with the capability of selecting preset holiday display patterns, known in advance of purchase. To the best of knowledge, these capabilities are not available anywhere in the prior art.

According to one aspect, the present invention provides unique light string system construction layout features including, for example, unique layout features of conductor pathways on a singular common insulator thereby allowing for multiple interconnections, which in turn provides for complex circuit paths to the LEDs in the bulb housings utilizing fewer current carrying conductors than used in the prior art. By utilizing unique layout features of conductor pathways on a singular common insulator, in a manner to be described in detail below, the LED light string system of the invention may be more easily mass produced in a continuous method of automated fabrication.

Various embodiments of the flat rope light string system of the invention may comprise at least one light string, coupled to and controlled by a controller. The one or more light strings being comprised of a plurality of bulb housings, each bulb housing having a plurality of LEDs, the LEDs being organized in pairs with each pair being configured in a back-to-back configuration such that a positive bias energizes a first LED of an LED pair and a negative bias energizes the second LED of the LED pair. Advantageously, the unique back-to-back configuration allows the LEDs to be alternatively energized in each pair such that a first LED from each pair is energized in a forward direction in a first phase of operation followed by the corresponding LED of the pair being energized in a reverse direction, in a second phase of operation. Where energizing the respective LED pairs occurs at a selectable energizing frequency, typically in the range of 120-180 Hz AC to obtain unique color output patterns not achievable by existing prior art flat rope light string systems.

The controller is arranged to change the color patterns of the at least one light string of the flat rope light string system of the invention by energizing and de-energizing the individual leads of the light strings and their polarity. In an illustrative example, the LED pairs within the respective bulb housings are electrically coupled such that a first positive voltage polarity is applied, via the controller, to the at least one light string to provide a turn-on bias to all of the positively biased LEDs in the LED pairs of the plurality of bulb housings, with a second negative voltage polarity being subsequently applied to the at least one light string to provide a turn-on bias to all of the negatively biased LEDs in the LED pairs of the plurality of bulb housings. The LED pairs being pre-determined at the time of manufacture. A resulting display illuminates a different color of in dependence of the type of bias being applied.

The controller of the flat rope light string system is preferably electrically coupled in parallel to the at least one light string, and in the case where there are at least two light strings, the at least two light strings are preferably coupled together in series via harnesses, which may, in some embodiments, be polarized harnesses for making the mating connection between the at least two light strings.

In various embodiments, the flat rope light string system includes; a voltage conversion module for converting a high voltage AC electric power source to a low voltage AC electric power source; a rectifier for accepting an input electrical power source to provide an output DC electrical power to the at least one light string and a controller electrically coupled to a power source at a first connection and electrically coupled, in parallel, to a plurality of light strings at a second connection, the second connection being preferably polarized. The plurality of light strings preferably having a polarized connector at one end for connection to the second connection of the controller such that the light strings are capable of only one connection orientation at the second connection, the light strings having a plurality of bulbs containing a first color LED and a second color LED, the LEDs within the bulbs electrically coupled so that a first voltage polarity applied to the light string provides a turn-on bias to the first color LEDs within the bulbs and a second voltage polarity applied to the light string provides a turn-on bias to the second color LEDs within the bulbs, the controller having switching means with a plurality of switch positions including: a first switch position for providing electrical power at the second connection to the LED light string by applying the first voltage polarity on a first connection lead, the first voltage polarity biasing the first color LED among the plurality of different colored lights within the lighting elements; the second switch position for providing electrical power at the second connection to the LED light strings by applying a second voltage polarity on the first connection lead, the second voltage phase biasing a second color LED among the plurality of different colored lights within the lighting elements; and a third switch position for providing electrical power at the second connection to the light string by simultaneously applying the first voltage polarity and the second voltage polarity on a third connection lead, the plurality of applied voltage phases simultaneously biasing the first color LED and the second color LED within the bulbs, the lighting element including a diffusion element for blending the colors of the plurality of biased lights. In some embodiments, it is contemplated to have six or more switch positions, each switch position corresponding to a different combination of connection lead and applied voltage polarity.

In one embodiment, a flat rope light string system includes a controller coupled to a power source at a first connection and at least one light string at a second connection, the second connection including at least two connection leads, the second connection being polarized such that the at least one light string is capable of only one connection orientation at the second connection, the at least one light string containing a plurality of lighting elements arranged in pairs, the controller having a switch with a plurality of switch positions, including: a first switch position for providing electrical power at the second connection to the light string by applying a first voltage polarity on a first connection lead, the first voltage phase biasing a plurality of first lights among the plurality of different colored lights within the lighting elements; a second switch position for providing electrical power at the second connection to the at least one light string by applying a second voltage phase on the first connection lead, the second voltage polarity biasing a plurality of second lights from among the plurality of different colored lights within the light elements; and a third switch position for providing electrical power at the second connection to the at least one light string by alternately applying the first and second voltage polarities at the second connection lead.

In another embodiment, a flat rope light string system includes a controller coupled to a power source at a first connection and at least one light string at a second connection, the second connection including at least three connection leads, the second connection being polarized such that the at least one light string is capable of only one connection orientation at the second connection, the at least one light string containing a plurality of lighting elements arranged in pairs, the controller having a switch with a plurality of switch positions, including: a first switch position for providing electrical power at the second connection to the light string by applying a first voltage polarity on a first connection lead, the first voltage polarity positively biasing a plurality of first lights among the plurality of different colored lights within the lighting elements; a second switch position for providing electrical power at the second connection to the at least one light string by applying a second voltage polarity on the first connection lead, the second voltage polarity negative biasing a plurality of second lights among the plurality of different colored lights within the light elements; and a third switch position for providing electrical power at the second connection to the at least one light string by applying the first voltage polarity on the second connection lead, the second voltage polarity positively biasing a plurality of second lights among the plurality of different colored lights within the light elements; and a fourth switch position for providing electrical power at the second connection to the at least one light string by applying the first voltage polarity on the second connection lead, the second voltage polarity negatively biasing a plurality of second lights among the plurality of different colored lights within the light elements; and a fifth switch position for providing electrical power at the second connection to the at least one light string by applying the first voltage polarity on the third connection lead, the first voltage polarity positively biasing a plurality of second lights among the plurality of different colored lights within the light elements; and a sixth switch position for providing electrical power at the third connection to the at least one light string by applying a second voltage polarity on the second connection lead, the second voltage polarity negatively biasing a plurality of second lights among the plurality of different colored lights within the light elements; and a seventh switch position for providing electrical power simultaneously at the first, second and third connections to the at least one light string by applying the second voltage polarity on the second connection lead, the second voltage polarity negatively biasing the plurality of different colored lights within the light elements; and an eighth switch position for providing electrical power simultaneously at the first and third connections to the at least one light string by applying a first voltage polarity on the second connection lead, the first voltage polarity positively biasing a plurality of first and third lights from among the plurality of different colored lights within the light elements; and a ninth switch position for providing electrical power simultaneously at the first and third connections to the at least one light string by applying a second voltage polarity on the second connection lead, the second voltage polarity negatively biasing the plurality of different colored lights within the light elements; and a tenth switch position for providing electrical power simultaneously at the first and third connections to the at least one light string by alternatingly applying a first voltage polarity on the second connection lead and a second voltage polarity on the second connection lead, the first voltage polarity positively biasing a plurality of first lights among the plurality of different colored lights within the lighting elements, the second voltage polarity negatively biasing a plurality of second lights from among the plurality of different colored lights within the light elements; and an eleventh switch position for providing electrical power simultaneously at the first, second and third connections to the at least one light string by simultaneously applying a first voltage polarity on the second connection lead and a second voltage polarity on the first and third connection leads, the first voltage polarity positively biasing a plurality of first lights among the plurality of different colored lights within the lighting elements, the second voltage polarity negatively biasing a plurality of second and third lights from among the plurality of different colored lights within the light elements;

In certain preferred aspects of the invention, the plurality of different colored lights are multicolored LEDs and the lighting element is a bulb containing the multicolored LEDs.

In one aspect, the two or more light strings of a flat rope light string system comprise a plurality of multi-colored LEDs placed in lighting elements at specific locations on a flat rope. The specific bulb placements being determined at a time of manufacture. The LEDs capable of being energized in a forward or reverse bias, as selected by a controller. The energizing state allowing the multi-colored LEDs to change from one holiday pattern to another In another aspect, LED pairs are connected back-to-back in bulb housings on a flat rope of a flat rope light string system. The LED pairs capable of being energized in a forward and reverse bias as selected by a controller. "Back to back" LEDs herein, shall refer to LEDs that are connected in reverse parallel such that the anode of the first LED is connected to the cathode of the second LED and the anode of the second LED is connected to the cathode of the first LED, resulting in the LEDs being illuminated individually when the electrical current is applied in one direction one is illuminated and the other being illuminated when the electrical current is reversed.

In one embodiment, a circuit layout of the flat rope light string system is made in a continuous extrusion process with layers added by automated or semi-automated machinery. The continuous extrusion process provides flat conductors deposited on a singular common insulation. Further, this process results in fewer current carrying conductors than conventional LED light strings. The construction of the inventive flat rope string of LEDs versus a string of LEDs as is common in the art, advantageously eliminates a multiplicity of parts and materials, for example, the need for sockets for each bulb, bulb bases for the bulbs and terminals in the sockets and the material cost fabrication cost and labor to assemble the parts.

In one embodiment, the flat rope light string system is made in a continuous extrusion process with layers added by automated or semi-automated machinery. The continuous extrusion process provides flat conductors deposited on a singular insulated surface. The invention further applies to a method of constructing a flat rope light string system. The method includes predetermining an arrangement and color of a plurality of multicolored LEDs in an LED light string at a time of manufacture, predetermining a proper biasing of a plurality of leads within the LED light string, coupling a controller to the LED light string, biasing the plurality of the multicolor LEDs within each lighting element on the light string via the controller.

Various embodiments may achieve one or more advantages. For example, under control of the controller, the various switch positions of the controller provide a plurality of preprogrammed color displays based on factory pre-set LED color combinations of the LED pairs and positions in the at least one light string, thereby providing unique color display options as compared to conventional rotating color combinations associated with conventional LED light strings. The possible arrangements of individual LED color selections is unique and virtually boundless by virtue of being selected at a time of manufacture to allow the illumination of specific pre-programmed patterns. For example, the holiday patterns as shown in the detailed charts. Notably, unlike conventional flat rope flat rope light string systems, customization of the lighting patterns of the flat rope light string system of the invention is achieved by requiring pre-programming of the lighting patterns at the time of manufacture.

It should be noted that the above-mentioned embodiments illustrate rather than limit the invention, and that those skilled in the art will be able to design many alternative embodiments without departing from the scope of the appended claims. In the claims, any reference signs placed between parenthesis shall not be construed as limiting the claim. The article "a" or "an" preceding an element does not exclude the presence of a plurality of such elements. The mere fact that certain measures are recited in mutually different dependent claims does not indicate that a combination of these measures cannot be used to advantage.

The details of various embodiments are set forth in the accompanying drawings and the description below. Other features and advantages will be apparent from the description and drawings, and from the claims.

BRIEF DESCRIPTION OF THE DRAWINGS

FIG. 1E depicts a chart illustrating the color assignments/pairings displayed by the LED light elements according to one embodiment of the invention;

FIG. 1F depicts a chart illustrating the output leads energized by the power source and the resulting color patterns displayed by the LED light elements for the various switch positions of the controller according to one embodiment of the invention;

FIG. 2D depicts a chart illustrating the color assignments/pairings displayed by the LED light elements of the flat rope light string system of FIG. 2A;

FIG. 2E depicts a chart illustrating the output leads energized by the power source and the resulting color patterns displayed by the LED light elements for the various switch positions of the controller of the flat rope light string system of FIG. 2A according to the embodiment of FIG. 2A;

FIG. 3D depicts a chart illustrating the output leads energized by the power source and the resulting color patterns displayed by the LED light elements for the various switch positions of the controller according to one embodiment of FIG. 3A;

FIG. 4D depicts a chart illustrating the color assignments/pairings displayed by the LED light elements according to the embodiment of FIG. 4A;

FIG. 4E depicts a chart illustrating the output leads energized by the power source and the resulting color patterns displayed by the LED light elements for the various switch positions of the controller according to one embodiment of FIG. 4A.

DETAILED DESCRIPTION OF THE INVENTION

The various embodiments and variations thereof illustrated in the accompanying figures and/or described herein are merely exemplary and are not meant to limit the scope of the inventio. It is to be appreciated that numerous variations of the invention have been contemplated as would be obvious to one of ordinary skill in the art with the benefit of this disclosure. Rather, the scope and breadth afforded this document should only be limited by the claims provided herein while applying either the plain meaning to each of the terms and phrases in the claims or the meaning clearly and unambiguously provided in this specification.

To facilitate a clear understanding of the present invention, illustrative examples are provided herein which describe certain aspects of the invention. However, it is to be appreciated that these illustrations are not meant to limit the scope of the invention, and are provided herein to illustrate certain concepts associated with the invention.

It is also to be understood that certain aspects of the present invention may be implemented in various forms of hardware, software, firmware, special purpose processors, or a combination thereof. Preferably, certain aspects of the present invention may be implemented in software as a program tangibly embodied on a program storage device. The program may be uploaded to, and executed by, a machine comprising any suitable architecture. Preferably, certain aspects of the invention are implemented on a computer platform having hardware such as one or more central processing units (CPU), a random-access memory (RAM), and input/output (I/O) interface(s). The computer platform may also include an operating system and microinstruction code. The various processes and functions described herein may either be part of the microinstruction code or part of the program (or combination thereof) which is executed via the operating system. In addition, various other peripheral devices may be connected to the computer platform such as an additional data storage device and a printing device.

Figure 1A:
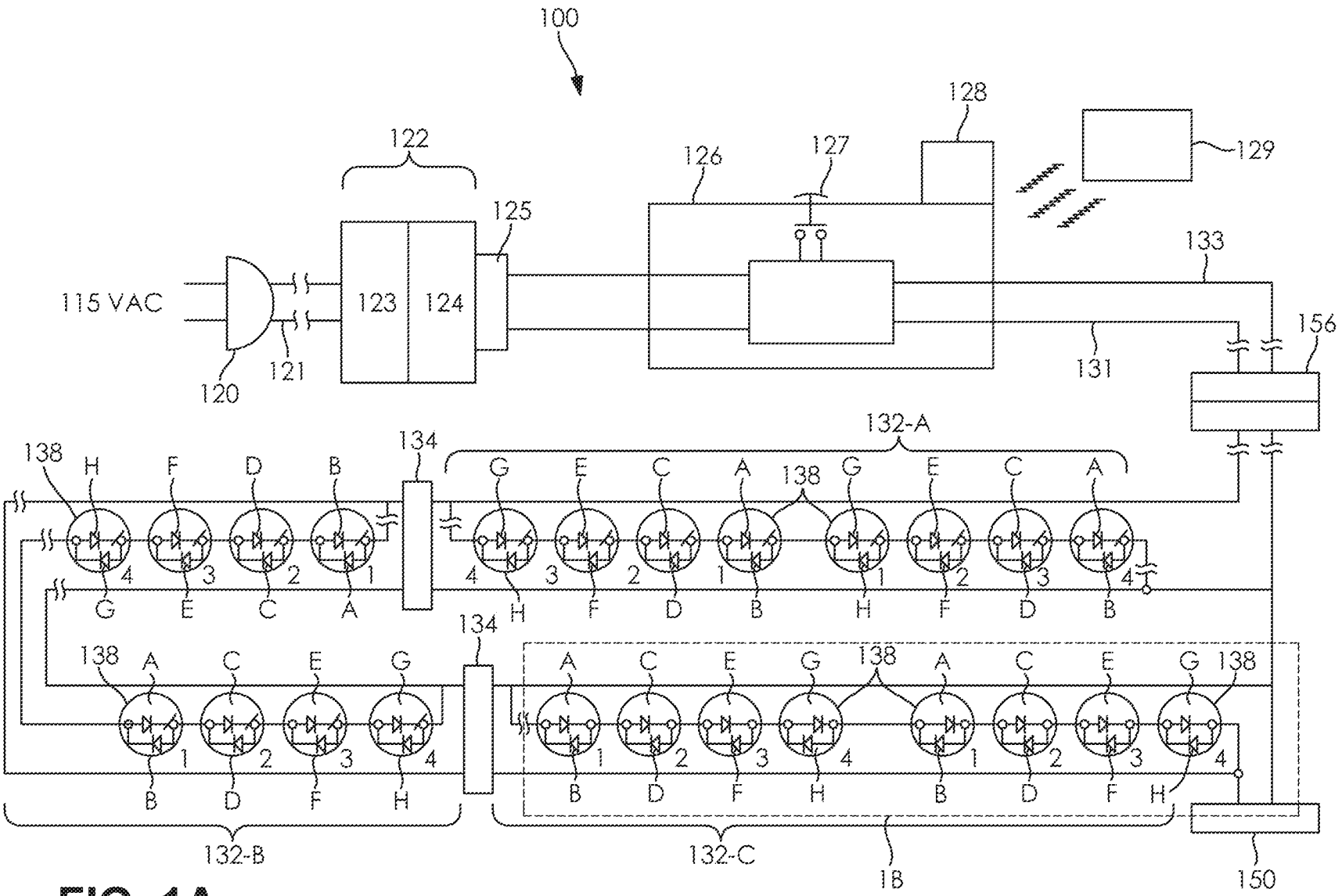
FIG. 1A is a circuit diagram of the invention according to one embodiment.

Although the physical construction and electrical circuit layout of the circuits have been specifically disclosed, those of skill in the art will appreciate that alternative physical constructions and electrical arrangements may exist to accomplish the above-described functions without departing from the teaching of the present invention FIGS. 1A-1F, illustrate a flat rope light string system in accordance with one embodiment of the present invention FIG. 1A shows a circuit diagram of a flat rope light string system 100 of the present invention. The flat rope light string system 100 includes a high-to-low voltage conversion and rectification module 122, a controller 126 and one or more light strings 132A-C. Three light strings are shown by way of example only. The high-to-low voltage conversion and rectification module 122 is connected at a first connection 121 to a high voltage power source 120, such as a typical 115V AC power source as found in a residence or a building. Connection 121 may be either polarized, meaning that it has only one connection orientation or unpolarized. The high-to-low voltage conversion and rectification module 122 is separated into two separate and discrete modules, namely, a voltage conversion module 123, for performing a high-to-low voltage conversion function and a rectification module 124 for performing a rectification function. The high-to-low voltage conversion and rectification module 122 may be composed of any known or heretofore developed commercial voltage converters such as those provided by power converters, power inverters, power adaptors or power transformers. The high-to-low voltage conversion and rectification module 122 is connected at a second connection 125 to the controller 126 including a manual switch 127 and a wireless receiver/transmitter head 128. Controller 126 provides various switching functions to control the light strings 132A-C of the light string system. Each of the three, light string 132A-C includes eight light elements 138, which are preferably bulb housings 138. Each light string 132A-C is wired in parallel between electrical connectors 131 and 133, with connector 133 being a common return. The light strings 132A-C are coupled together in series via harnesses 134, 150, 156. Harnesses 134, 150, 156 may be comprised of any of the standard male-female mating systems typically used for making electrical connections for light strings. Further, harnesses 134, 150, 156 may be polarized so that only one connection orientation is possible in making the mating connection between the two light strings.

While the present embodiment describes a flat rope light string system 100 having three LED light strings 132A-C, it is contemplated to utilize more or less light strings depending upon the application.

As stated above, the light strings 132A-C comprise eight bulb housings 138, each bulb housing 138 including a single dual color light-emitting diode (LED) pair (i.e., two LEDs) configured in a back-to-back orientation. Upon insertion of all the LED light elements {A/B, C/D, E/F, G/H} into sockets of the light strings 132A-C, the single lead circuit of the light strings are completed. It should be noted that the LEDs are arranged in the bulb housings in a back-to-back configuration such that a positive bias energizes a first LED of each LED pair and a negative bias energizes a second LED of each LED pair. Thus, the LEDs are biased and thereby illuminated in each light string 132A-C according to the following table:

TABLE I

| Connector ID | Applied Voltage | LED ID |
|---|---|---|
| 131 | Positive | Voltage applied to LED A |
| 131 | Negative | Voltage applied to LED B |
| 131 | Positive | Voltage applied to LED C |
| 131 | Negative | Voltage applied to LED D |
| 131 | Positive | Voltage applied to LED E |
| 131 | Negative | Voltage applied to LED F |
| 131 | Positive | Voltage applied to LED G |
| 131 | Negative | Voltage applied to LED H |

Notably, an applied positive voltage is applied to LED's {A, C, E, G} simultaneously. Similarly, an applied negative voltage is applied to LED's {B, D, F, H} simultaneously. Similarly, Controller 126 provides various switching functions to control the light strings 132A-C. It is understood that the flat rope light string system 100 may be organized in any feasible arrangement given the power supply capabilities of controller 126.

Operation of the switching functions of controller 126 is described as follows.

With switch button 127 of controller 126 positioned in a first rotary position, a positive polarity (+) DC voltage is conducted through the light strings 132A-C, coupled across conductor 131 and common return 133. In this first switch position, all of the positively biased LEDs within each of the respective bulbs housings 138 are illuminated, as further indicated in the table above. In accordance with the LED arrangement, a single-color positively biased LED from among the 2 LEDs of each LED pair will be illuminated in each bulb housing 138 in each light string 132A-C while positioned in this first rotary position.

With switch 127 of controller 126 positioned in a second rotary position, a negative polarity (−) DC voltage is conducted through the light strings 132A-C, coupled across conductor 131 and common return 133. In this second switch position, all of the negatively biased LEDs within each of the bulb housings 138 will be illuminated, as indicated in the table above. In accordance with the LED arrangement, a single-color negatively biased LED will be illuminated in each LED pair in each of the bulb housings 138 of light strings 132A-C. See table above.

According to the table above, the positively biased LEDs labeled {A, C, E, G} in each light string 132A-C will be illuminated by the first positive polarity (+) DC voltage in the first switch position. Thereafter, the negatively biased LEDs labeled {B, D, F, H} will be illuminated in each LED light string by the second negatively biased (−) DC voltage in the second switch position.

With switch 127 of controller 126 positioned in a third rotary position, with the input power maintained as 115 VAC and 120 Hz AC, both the positively biased LEDs {A, C, E, G} and the negatively biased LEDs {B, D, F, H} will be alternately illuminated as biased by an appropriate phase of the AC power cycle. More particularly, in this third switch position, the AC input power simultaneously provides two different DC power components, having two different polarities. For example, the two different polarities correspond to a positive DC level and a negative DC level, where each level (+/−) can range substantially between 18-24 volts DC. The different sets of LEDs {A, C, E, G} and {B, D, F, H} in each LED light string 132A-C appear to the eye to illuminate simultaneously in this third rotary position. In a practical application, the "flicker" that is taking place electrically through the alternation of the phases is likely to be imperceptible to the human eye and the light string will have the appearance of having all the LEDs, {A, C, E, G} and {B, D, F, H}, in each LED light string 132A-C on simultaneously. In this fashion, more than two colors may be obtained from a single light element.

Alternatively, or in addition, remote control capability may be added for switching the controller 126. For example, in an embodiment shown in FIG. 1A, wireless receiver/transmitter head 128 is included in controller 126 for coordinating wireless communication with remote 129 having its own wireless receiver/transmitter head. A push-button switch on the remote 129 is used to switch the switch position 127 of the controller and wireless signals are exchanged between the receiver/transmitter.

Figure 1B:
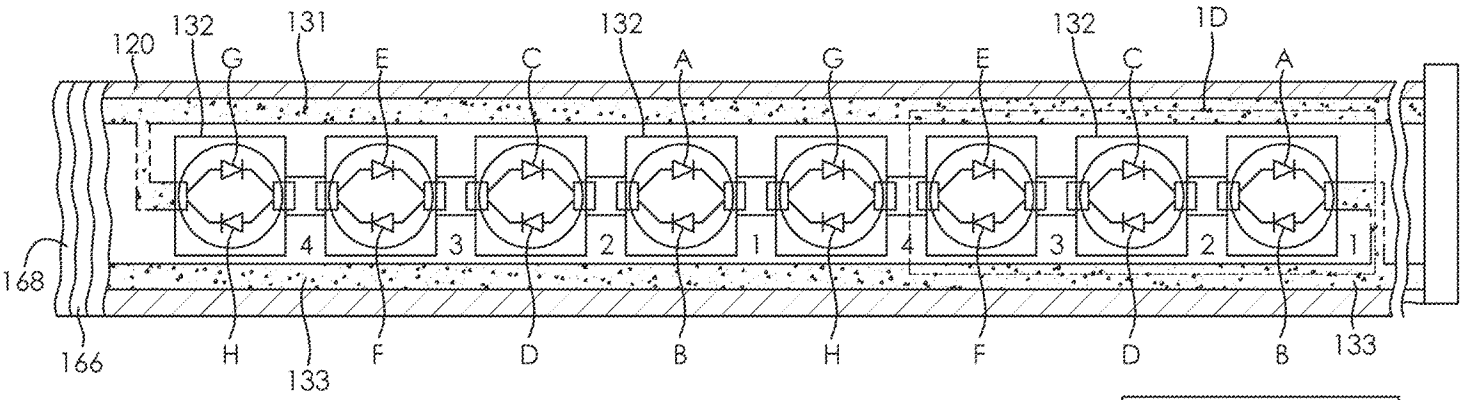
FIG. 1B depicts a top down partial cut-away view of a plurality of interconnected LED bulb housings comprising a portion of a flat rope light string system, according to one embodiment of the present invention.
Figure 1C:
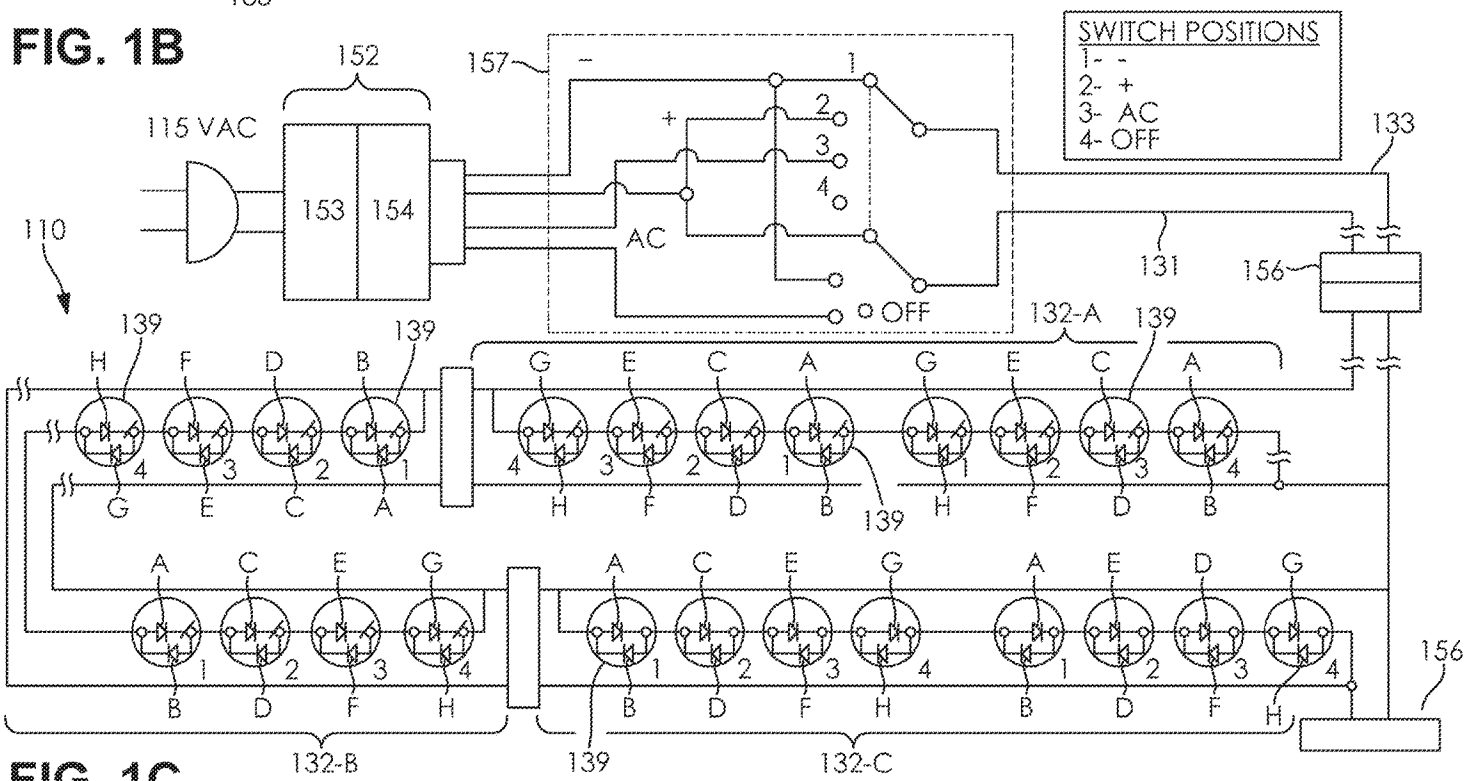
FIG. 1C is a circuit diagram of the invention according to one embodiment.

Referring now to FIG. 1C, there is shown a circuit diagram of a flat rope light string system 300 according to a variation of the first embodiment of the invention shown in FIG. 1A. That is, the flat rope light string system 300 includes many of the same components introduced in FIG. 1A above. However, one notable distinction between the two circuit representations is that in the present embodiment, there is shown a four-position rotary selection switch 157 which replaces controller 126 of the first embodiment. In contrast to the controller 126 of the first embodiment, which automatically sequences through the various phases of operation, i.e., first, second and third phase, as described above, in the present embodiment, sequencing through the various phases is performed manually via the four-position rotary selection switch 157, as shown in FIG. 1C. The four-position rotary selection switch 157 allows a user to manually select any of the previously described phases of operation, namely, (1) positive polarity DC voltage, (2) negative polarity DC voltage, and (3) 120 Hz AC voltage, with the fourth position of selection switch 157 being the OFF position. Notably, in each of the two embodiments described above, when a particular rotary switch position is selected or a controller selection is made, the predetermined illumination pattern will repeat continuously until the user actively selects a different rotary switch position or controller selection.

Figure 1D:
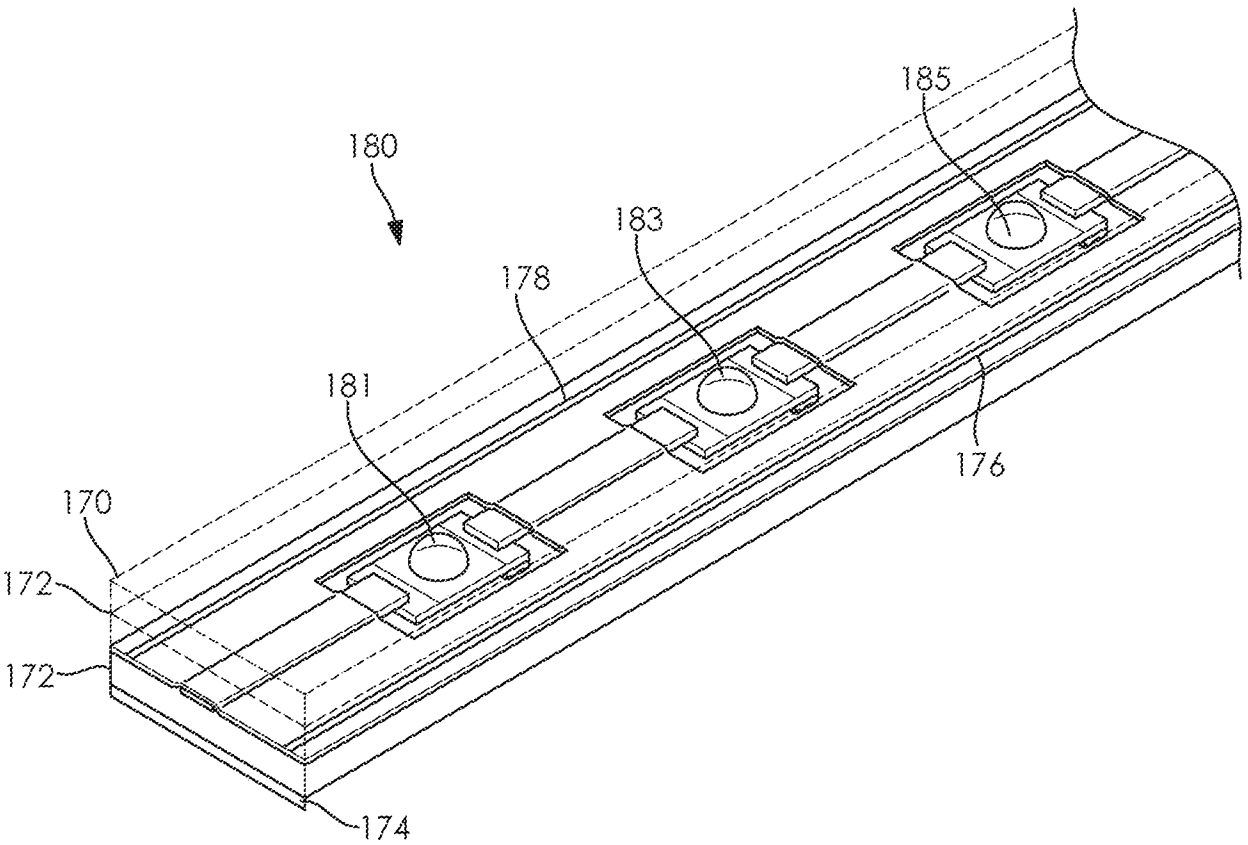
FIG. 1D depicts a perspective view of a portion of FIG. 1B according to one embodiment.

Referring now to FIG. 1D, a flat rope light string system 180 constructed in accordance with one embodiment of the invention comprises a plurality of LEDs 181, 183, 185 in series, (two of which are shown) electrically coupled to power leads 176, 178 in the insulator substrate 172 for powering the LEDs. When connected with a controller, such as the one shown in FIG. 1A or rotatory switch position selector as shown in FIG. 1C, for providing different illuminations, the LEDs 181, 183 will light up sequentially.

Specifically, those LEDs coupled to the first power lead 176 will light up with the application of a positive polarity DC voltage (+). Upon switching from the first switch position to the second switch position, those LEDs coupled to the second power lead 178 will light up with the application of a negative polarity DC voltage (–). The power leads 176, 178 are shown on the same insulation substrate.

With reference back to the circuit depictions of FIG. 1A and FIG. 1C, in the third switch position of controller 126, a flashing effect of the flat rope light string system 180, as shown in FIG. 1D, is observed as alternating positive and negative polarity DC current being fed to power leads 176, 178. More particularly, as power lead 176 goes positive, power lead 178 simultaneously goes negative. This process is then reversed with power lead 176 going negative while power lead 178 simultaneously going positive. Advantageously, a flashing effect is achieved without the provision of diodes, as is required in conventional flat rope system constructions.

With continued reference to FIG. 1D, the flat rope light string system 180 is shown to be enclosed in a clear insulator 170, which comprises a flat rectangular section. In the present embodiment, an adhesive layer 174 is mounted to an insulator substrate 172. The adhesive layer 174 includes a first adhesive material on the bottom side of the adhesive layer 174 and a second adhesive material on the top side of the adhesive layer 174. The insulator substrate 172, may include one or more sheets of ceramic, metal, laminate, circuit board, Mylar, or another suitable material. A plurality of apertures 185 are provided for receiving the LEDs 181, 183 and screws.

According to one aspect, the apertures 185 for housing the LEDs lie axially and centrally along the length of the insulator substrate 172. However, it is contemplated that the apertures can lie in a different pattern in other embodiments. The apertures 185 provide a novel and convenient means to provide power to the LEDs 181, 183 and are known to people having ordinary skill in the art. However, other means for conveying power to the LEDs 181, 183, as will be described in detail below.

In contrast to the circuit construction of the invention, shown in FIGS. 1B and 1D, there is shown a top down partial cut-away view of a flat rope LED light string 190 construction according to the prior art. The circuit construction of the present invention provides numerous advantages and overcomes the drawbacks associated with such prior art constructions, such as the one shown in FIG. 1G, described as follows.

Figure 1G:
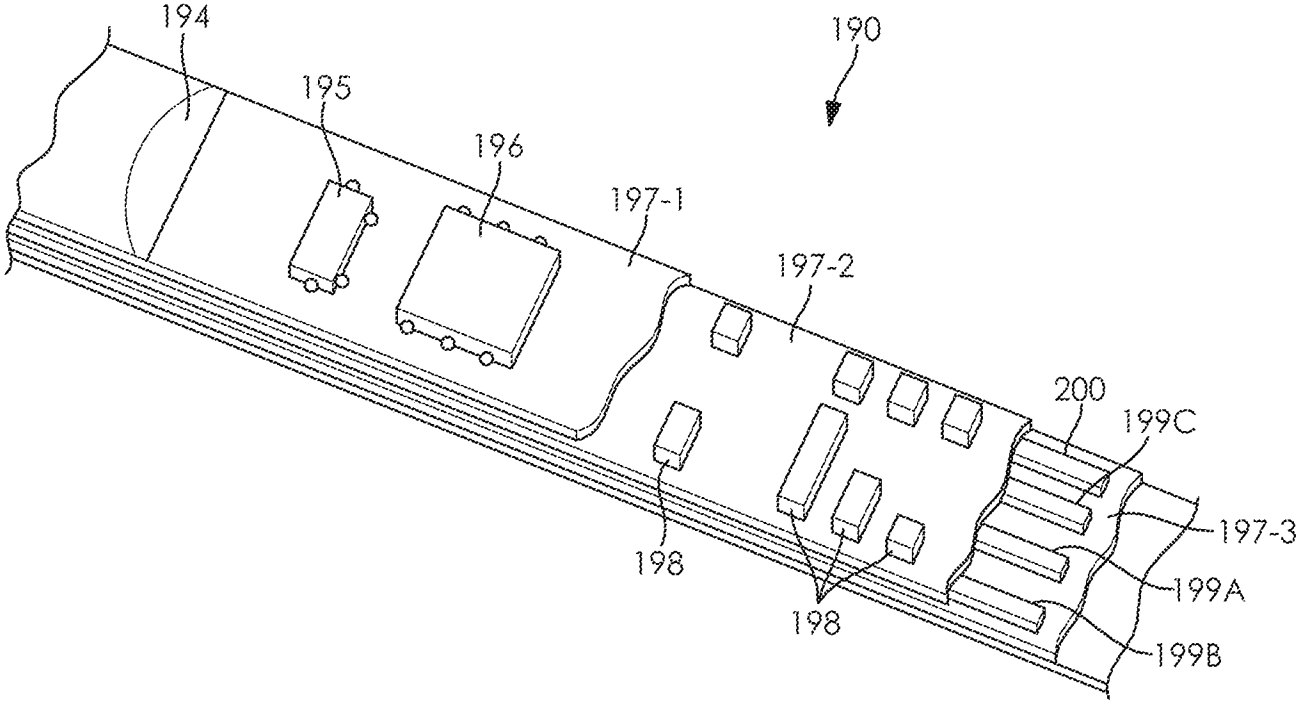
FIG. 1G (PRIOR ART)
FIG. 1G depicts a top down partial cut-away view of a plurality of interconnected LED bulb housings of a conventional flat rope light string system, according to the prior art.

A drawback of existing flat rope LED systems of the prior art, such as the one shown in FIG. 1G, relates to the complexity of their construction. The conventional flat rope LED system 190 shown in FIG. 1G includes a plurality of interconnected LED bulb housings, embedded within component 196 on the first layer of a multi-layer construction. Specifically, component 196 on the first layer 197-1 includes 3 LED bulb housings with 3 different colored LEDs per housing, sometimes referred to in the art as a segment. The 3 LED bulb housings are typically arranged in parallel within a segment, with each LED bulb housing in the segment being sourced from a separate power lead and a common return lead. The conventional flat rope LED system 190 shown in FIG. 1G includes a clear insulation layer 194, as a top layer, below which there is shown the aforementioned first layer 197-1 which includes: component 196 including 3 LED bulb housings, a plurality of resistors 195, one for each different color LED in the 3 LED bulb housings. For example, in an embodiment, an LED bulb housing 196 may include 3 different colored LEDs (e.g., Red, Blue, Green), which would require a need for 3 resistors for each segment, one resistor per color, where a segment comprises 3 LED bulb housings in parallel.

The conventional flat rope LED system 190 shown in FIG. 1G further includes a number of jumper conductors 198 on a second layer 197-2. The jumper conductors 198 of the second layer 197-2 allow each LED in the LED bulb housing 196 of the first layer to connect to its dedicated power source via dedicated power leads shown on the third layer 197-3 via plated thru holes (not shown). Three dedicated LED power leads 199A-C are shown on the third layer 197-3. LED power lead 199A sources a first LED of the 3 segment LED 196 of layer 197-1. LED Power lead 199B sources a second LED of the 3 segment LED 196 of layer 197-1, and LED Power lead 199C sources a third LED of the 3 segment 196 of layer 197-1. There is also shown a common lead 200 on layer 197-3 corresponding to the power leads 199A-C.

As stated above, a drawback of existing flat rope LED systems of the prior art, such as the one shown in FIG. 1G, relates to the complexity of their construction. More particularly, conventional flat rope LED systems have multi-layers of foil conductors, such as the three-layered construction 197-1, 197-2, 197-3 as shown in FIG. 1G. A disadvantage of such a multi-layer construction is the need to use jumpers to connect the LED bulb housing 196 on layer 197-1 with the lower layer LED power conductors 199A-C on layer 197-3. A further disadvantage is that jumper conductors 198 are also required, on the intermediate layer 197-2 for connecting the three LEDs 196 on layer 197-1, the power lead layer 197-2, including common lead 200. A further drawback of conventional flat rope LED systems is the need for additional components, such as resistors and capacitors. For example, FIG. 1G includes resistor 195 which is typically mounted on the top layer 197-1 to adjust the voltage level.

FIG. 1B is a top down partial cut-away view of the circuit configuration of FIG. 1D which includes a plurality of interconnected LED bulb housings 132 where pairs of LEDs in each housing (e.g., pairs A/B, C/D, E/F, G/H) are coupled together in a novel back-to-back configuration, as described herein. Further elements of the construction include, an adhesive layer 168, an insulation layer 166 adjacent to the adhesive layer 168, two primary current carrying connectors 131, 133, and an AC wall plug connector 120. The aforementioned drawbacks of existing flat rope LED light string systems is overcome by the circuit configuration of FIG. 1B. These advantages include, but are not limited to, optimized device placement, back-to-back placement of LEDs, minimized component count and utilization of a single layer foil conductor. Each advantage will be described in further detail as follows.

A first advantage afforded by the circuit construction of embodiments of the invention, as exemplified by the circuit construction of FIG. 1B, is the placement of the LEDs in a back-to-back configuration. See, for example, LEDs {A/B}, {C/D}, {E/F}, {G/H], shown arranged in a back-to-back configuration in FIGS. 1A, 1C, 2A, 3A and 4A. The back-to-back configuration of the LED pairs advantageously removes the need for multiple separate power leads to each LED, such as the three separate power leads 199A-C shown in the prior art circuit construction of the flat rope LED light string system FIG. 1G. The back-to-back circuit construction advantageously uses the same conductors, instead of multiple separate power leads, but by reversing the polarity in operation, the individual LEDs illuminate alternatingly. If the LEDs were on separate dedicated leads, as shown in FIG.

1G, then an additional lead would be required. More particularly, the additional lead could be a common return lead, with the overall requirement being three leads required in total, (i.e., a power lead for each of the two LEDs of the LED pair and a shared common lead.

A second advantage afforded by the circuit construction of embodiments of the invention, is the absence of resistors and capacitors on the top layer of the flat rope LED system, such as those shown in the prior art construction of FIG. 1G. The need for these additional components (i.e., resistors and capacitors) is overcome by the circuit construction of the invention by virtue of installing these additional components in the controller and accommodating this change by matching the series of LEDs to the output of the controller.

A third advantage afforded by the circuit construction of embodiments of the invention, is the use of a single layer of foil conductors. In contrast to using a single layer of foil of conductors, the prior art construction of FIG. 1G utilizes multiple foil layers (e.g., three or more layers). More particularly, referring to FIG. 1G, a lower layer foil conductor 197-3 supplies the various power leads or conductors for each different colored LED and the common return. A separate middle or adjoining foil layer 197-2 provides jumper conductors from the individually colored LEDs in each housing on the upper layer 197-1 to the power leads 199A-C and common lead 200 on the lower layer 197-3. Notably contact between the upper layer jumpers and the lower layer power leads and is made by a "Plated thru" type of connection.

FIG. 1E is a color assignment/pairings chart describing the LED bulb color assignments and bulb color pairings in the LED bulb housings 138 of the first embodiment and the LED bulb housings 139 of the second embodiment.

With reference to FIGS. 1C and 1E, LED "A" is shown paired with LED "B" in a back-back configuration in the first bulb housing of respective LED light strings 132-A through 132-C. LED "A" is pre-selected at the factory as a "white" bulb and LED "B" is pre-selected at the factory as a "red" bulb. In an embodiment, the bulb colors may be selected by a user/customer at the time of manufacture from among a plurality of manufacturer display options. Alternatively, a customer could request different color combinations of their own choosing.

FIG. 1F is a color output chart associated with the color assignment/pairings chart of FIG. 1E. The color output chart describes the resulting illumination (i.e., actual color output) of a particular flat rope light string system as the flat rope light string system is cycled through its various energized states of operation, described as follows.

Referring to row 1 of the color output chart of FIG. 1F, there is shown resulting illuminations for the three switch positions of the respective controllers 127, 157 illustrated in FIGS. 1A and 1C. In a first switch position, under control of controller 127, 157, a positive polarity DC voltage is generated by the light system thereby energizing LEDs "A", "E", "I" and LEDs "M" "A, C, E and G" in each of the LED light strings 132A-C of flat rope light string systems 100, 110 of FIGS. 1A and 1C. In this first switch position, the resulting illumination (i.e., actual color output) is selected to be white corresponding to both everyday events and Christmas as shown in the last column of the chart of FIG. 1F.

Upon switching the controller 127, 157 from the first switch position to the second switch position, a negative polarity DC voltage is generated energizing LEDs "B", "F", "J", "N" and LEDs "B, D, F and H" in each of the LED light strings 132A-C of flat rope light string systems 100, 110 of FIGS. 1A and 1C. In this second switch position, the resulting illumination (i.e., actual color output) will be a combination of "red, green, yellow, blue" corresponding to Christmas, as shown in the last column of the chart.

Upon switching the controller 127, 157 from the second switch position to the third switch position, an alternating 120 Hz output is generated that generates an alternating positive polarity DC voltage and negative polarity DC voltage, as described above, at a rate of 120 Hz. In this third switch position, the resulting illumination (i.e., actual color output) will be white a combination of pastel colors corresponding to Easter, as shown in the last column of the chart.

Although the physical construction and electrical circuit layout illustrated in FIGS. 1A and 1C have been specifically disclosed, those of skill in the art will appreciate that alternative physical constructions and electrical arrangements may exist to accomplish the above-described functions without departing from the teaching of the present invention Referring now to FIGS. 2A-2E, schematic diagrams and associated charts illustrating a flat rope light string system in accordance to with a further embodiment of the present invention are shown.

Figure 2A:
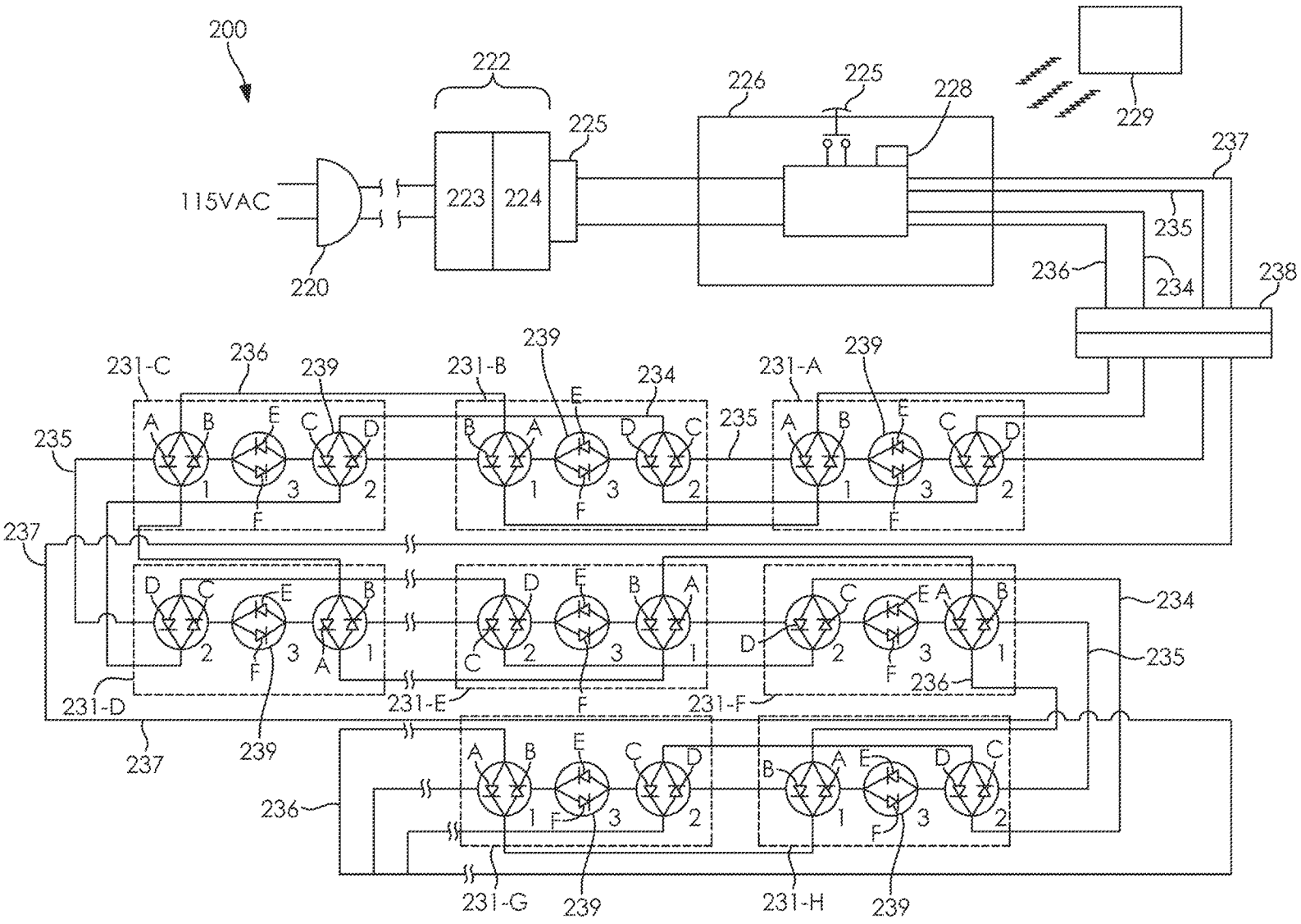
FIG. 2A depicts a circuit diagram of a flat rope light string system according to one embodiment.

Referring to FIG. 2A, there is shown a flat rope light string system 200 including a controller 226, a high-to-low voltage conversion and rectification module 222, and eight light strings 231A-H. Each light string 231A-H comprises 3 LED bulb housings 239. Each light string 231A-H is coupled to controller 226 in parallel. The flat rope light string system 200 of the present embodiment utilizes 8 light strings, each comprising 3 LED bulb housing, each bulb housing including 3 LED pairs provide a more robust set of illuminations than what may be achieved from the circuit diagrams of the embodiments shown in FIGS. 1A and 1C, as described above. More particularly, by providing 3 LED pairs per bulb housing in the present embodiment instead of 2 LED pairs per bub housing, as described in the previous embodiment, a wider variety of lighting combinations can be provided.

Alternatively, or in addition, remote control capability may be added for switching the controller 226. Wireless receiver/transmitter head 228 may be included in controller 226 for coordinating wireless communication with remote 229 having its own wireless receiver/transmitter head (not shown). A push-button switch on the remote is used to switch the switch position of the controller and wireless signals are exchanged between the receiver/transmitter.

Figure 2B:
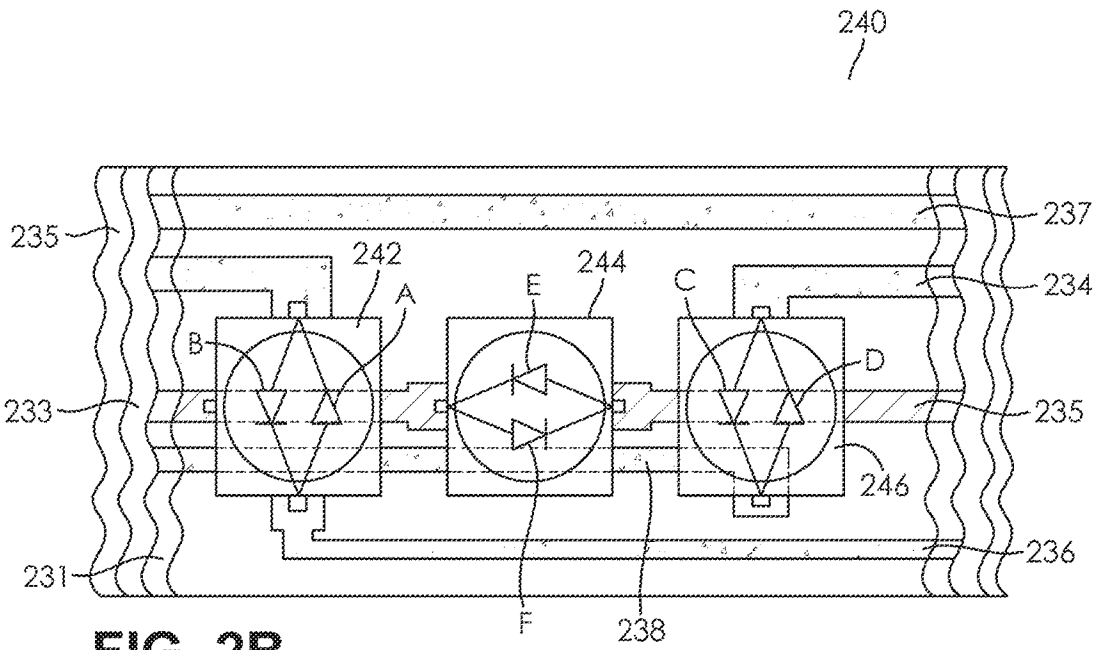
FIGS. 2B & 2C depict a top down partial cut-away view and a side cut-away view of three interconnected LED bulb housings of the flat rope light string system of FIG. 2A according to one embodiment of the present invention.

Although the physical construction and electrical circuit layout of FIG. 2A have been specifically disclosed, those of skill in the art will appreciate that alternative physical constructions and electrical arrangements may exist to accomplish the above-described functions without departing from the teaching of the present invention Referring now to FIG. 2B there is a top down view of a circuit layout of a portion of the circuit of FIG. 2A. The circuit layout 240 of FIG. 2B comprises sticky backing layer 235 as the outermost layer. On top of sticky backing layer 235, there is shown insulting substrate layer 233. A single layer of conductors 234, 235, 236 and 237 allows the LED pairs to be connected in a back-to-back configuration. The entire circuit layout is encapsulated at the uppermost layer with a clear insulator layer 231.

The circuit layout 240 of FIG. 2B provides unique advantages over conventional circuit layouts in a number of aspects. These aspects include, for example, circuit conductor layout and LED bulb housing arrangements, to be described as follows.

In one aspect, a key difference between the circuit construction shown in FIG. 2B and conventional circuit layouts, such as the one shown in FIG. 1G, is the placement of the single layer of conductors 234, 235, 236, 237 on the insulating substrate layer 233 to take advantage of the insulated bottom of the LED bulb housings. Specifically, the insulated housings 242 and 246 straddles the multiple conductors 234, 235, 236, 237 to allow the LEDs to be inter-connected in a novel back-to-back configuration without the need for jumper wires to bridge the connection between the conductors and the LEDs.

In a further aspect, a second key difference between the circuit construction shown in FIG. 2B and conventional circuit layouts, such as the one shown in FIG. 1G, is the unique orientation of the bulb housing arrangements 242, 244, 246. Specifically, the housing arrangements shown in FIG. 2B are uniquely oriented to preclude the need for jumper wires, described below, or a second level of conductors, thereby saving manufacturing steps and costs and thereby yield a more compact footprint. Specifically, LED bulb housing 244 houses LED Pair (E/F), which is oriented at 90 degrees with respect to the adjacent housings LED housing 242 housing LED Pair (A/B), to the left of LED Pair (E/F), and LED housing 246 housing LED Pair (C/D), to the right of LED Pair (E/F). By only changing the orientation of the middle LED bulb housing 244 with respect to the left and right housings 242, 246, current carrying conductors 235, 238 advantageously pass directly underneath the middle housing. Such an arrangement advantageously precludes the need for jumper wires or a second level of conductors, thereby saving manufacturing steps and costs. It should be understood that by placing all of the housings in the same orientation, as is done conventionally, jumper wires would be required because the leads would have to be in parallel making the flat rope wider and the jumper wires would have to reach over some of the conductors (leads) to attach to desired conductors. Alternatively, instead of utilizing jumper wires, the housings would be required to be much wider to accommodate different attachment points to connect to each set of parallel conductors.

Figure 2C:
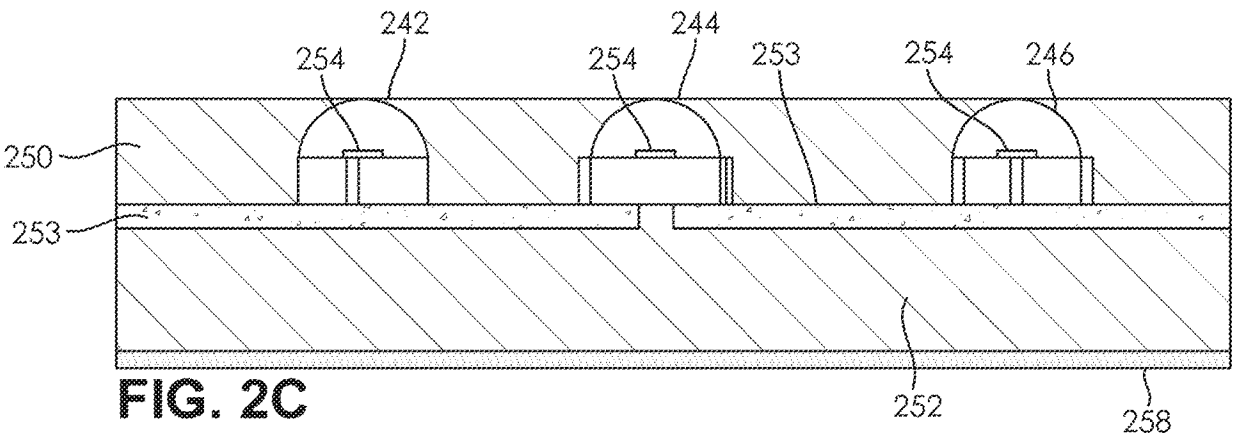

FIG. 2C is a cross sectional view of the partial circuit representation of FIG. 2B. The circuit layout of FIG. 2C comprises sticky backing adhesive layer 258 as the outermost layer. On top of sticky backing layer 258, there is shown insulting substrate layer 252. The entire circuit layout is encapsulated at the uppermost layer with a clear insulator layer 250. Embedded in the clear insulation layer 252 there is shown LEDs 254 in respective lens bulb housings 242, 244, 246. The LEDs in housing 244 being powered by power lead 253.

FIG. 2D is a color assignment/pairings chart describing the bulb color assignments and bulb color pairings in the LED bulb housings 239 of FIG. 2A. FIG. 2D will be described with respect to the first two rows of the chart.

TABLE II

| ROW | LED ID | LIGHT STRING SET ID | BULB ID | BULB COLOR | COLOR PAIRINGS |
|---|---|---|---|---|---|
| 1 | A | 231-A | BULB 1 | ORANGE | ORANGE/WHITE |
| 2 | B | 231-A | BULB 1 | WHITE | ORANGE/WHITE |

LED "A" is paired with LED "B" in a back-to-back configuration in a first bulb housing 239 of string set 231-A. LEDs "A" and "B" are pre-selected at the time of manufacture as "white" and "orange". The pre-selected color pairings allow for certain desired display patterns (e.g., Christmas, everyday events, national holidays, etc.) which illuminate in various switch positions of the light string system. The illuminations are described in detail in the color output chart of FIG. 2E.

FIG. 2E is a color output chart associated with the color assignment chart of FIG. 2D. The color output chart describes the actual color output (i.e., resulting illumination) of the circuit of FIG. 2A when cycled through its various energized states of operation via switch positions 1-12.

With reference to the color output chart of FIG. 2E, the various energized states of operation are described with reference to the switch positions 1-12. Referring to the first row of the chart, In a first switch position, selectable via controller 226, a positive polarity DC voltage (+) will be output by the controller 226 on lead 236 energizing LED "A" of bulb 1 in parallel in each of the eight string sets 231-A through 231-H. This results in an "orange" illumination pertaining to the Christmas holiday, as shown in the last column of FIG. 2E.

With reference to row 2 of the color output chart of FIG. 2E, in a second switch position selectable via controller 226, a negative polarity DC voltage (−) will be output by the controller 226 on lead 236 energizing LED "B" in in each of the eight string sets 231-A through 231-H. This results in a purely white illumination pertaining to both everyday events and the Christmas holiday, as shown in the last column of the chart of FIG. 2E.

With reference to row 3 of the color output chart of FIG. 2E, in a third switch position selectable via controller 226, a positive polarity DC voltage (+) will be output by the controller 226 on lead 234 energizing LED "C" in in each of the eight string sets 231-A through 231-H. This results in a green illumination pertaining to the Christmas holiday, as shown in the last column of the chart of FIG. 2E.

With reference to row 4 of the color output chart of FIG. 2E, in a fourth switch position selectable via controller 234, a negative polarity DC voltage (−) will be output by the controller 226 on lead 234 energizing LED "D" in in each of the eight string sets 231-A through 231-H. This results in a blue illumination pertaining to the Christmas holiday, as shown in the last column of the chart of FIG. 2E.

With reference to row 5 of the color output chart of FIG. 2E, in a fifth switch position selectable via controller 226, a polarity DC voltage (+) will be output by the controller 226 on lead 235 energizing LED "E" in in each of the eight string sets 231-A through 231-H. This results in a purple illumination pertaining to the Christmas holiday, as shown in the last column of the chart of FIG. 2E.

With reference to row 6 of the color output chart of FIG. 2E, in a sixth switch position selectable via controller 226, a negative polarity DC voltage (−) will be output by the controller 226 on lead 235 energizing LED "F" in in each of the eight string sets 231-A through 231-H. This results in a red illumination pertaining to the Christmas holiday, as shown in the last column of the chart of FIG. 2E.

With reference to row 7 of the color output chart of FIG. 2E, in a seventh switch position selectable via controller 226, a negative polarity DC voltage (−) will be output by the controller 226 on leads 234, 235, 236 energizing LEDs "B", "D", "F", in in each of the eight string sets 231-A through 231-H. This results in a red, white and blue illumination pertaining to United States National holidays, as shown in the last column of the chart of FIG. 2E.

With reference to row 8 of the color output chart of FIG. 2E, in an eighth switch position selectable via controller 226, a positive polarity DC voltage (+) will be output by the controller 226 on leads 235, 236 energizing LEDs "A", "E", in in each of the eight string sets 231-A through 231-H. This results in an orange and purple illumination pertaining to Mardi Gras and Halloween events, as shown in the last column of the chart of FIG. 2E.

With reference to row 9 of the color output chart of FIG. 2E, in a ninth switch position selectable via controller 226, a negative polarity DC voltage (−) will be output by the controller 226 on lead 236 energizing LED "B" in each of the eight string sets 231-A through 231-H. The controller 226 also provides a positive (+) DC current on lead 234 resulting illumination of LED C in each of the 8 string sets 231-A through 231-H. This results in a purely "White and Green Alternating illumination for Christmas and St. Pat's day holiday, as shown in the last column of the chart of FIG. 2E.

With reference to row 10 of the color output chart of FIG. 2E, in a tenth switch position selectable via controller 226, a negative polarity DC voltage (−) will be alternatingly output with a positive polarity DC voltage (+) by the controller 226. The negative polarity DC voltage (−) will be output on lead 236 energizing LED "A" and, in alternation with positive polarity DC voltage (+) being output on lead 235 energizing LED "C" in in each of the eight string sets 231-A through 231-H. This results in an alternating illumination of green and white pertaining to both the Christmas holiday and St. Patrick's, as shown in the last column of the chart of FIG. 2E. The rate of alternation can be varied and can be, for example, a 1 second rate of alternation.

With reference to row 11 of the color output chart of FIG. 2E, in an eleventh switch position selectable via controller 226, a negative polarity DC voltage (−) will be output by the controller 226 on lead 236 energizing LED "B" in in each of the eight string sets 231-A through 231-H. A positive polarity DC voltage (+) will be output by the controller 226 on lead 234 energizing LED "C" in in each of the eight string sets 231-A through 231-H. A negative polarity DC voltage (−) will be output by the controller 226 on lead 235 energizing LED "F" in in each of the eight string sets 231-A through 231-H. This results in a white, green and red illumination pertaining to both the Christmas holiday, and Italian and Mexican national holidays, as shown in the last column of the chart of FIG. 2E.

With reference to row 12 of the color output chart of FIG. 2E, in a twelfth switch position selectable via controller 226, a positive polarity DC voltage (+) will be output by the controller 226 on lead 236 energizing LED "A" in in each of the eight string sets 231-A through 231-H, followed by a positive polarity DC voltage (+)output by the controller 226 on lead 236 energizing LED "C" in in each of the eight string sets 231-A through 231-H, followed by a negative polarity DC voltage (−)output by the controller 226 on lead 235 energizing LED "F" in in each of the eight string sets 231-A through 231-H, followed by a negative polarity DC voltage (−)output by the controller 226 on lead 234 energizing LED "D" in in each of the eight string sets 231-A through 231-H. This sequence will repeat in alternating fashion resulting in a orange, green, red and blue illumination pertaining to the Christmas holiday, as shown in the last column of the chart of FIG. 2E.

Referring now to FIGS. 3A-3D, schematic diagrams and associated charts illustrating a flat rope light string system 300 in accordance with another embodiment of the present invention are shown.

Figure 3A:
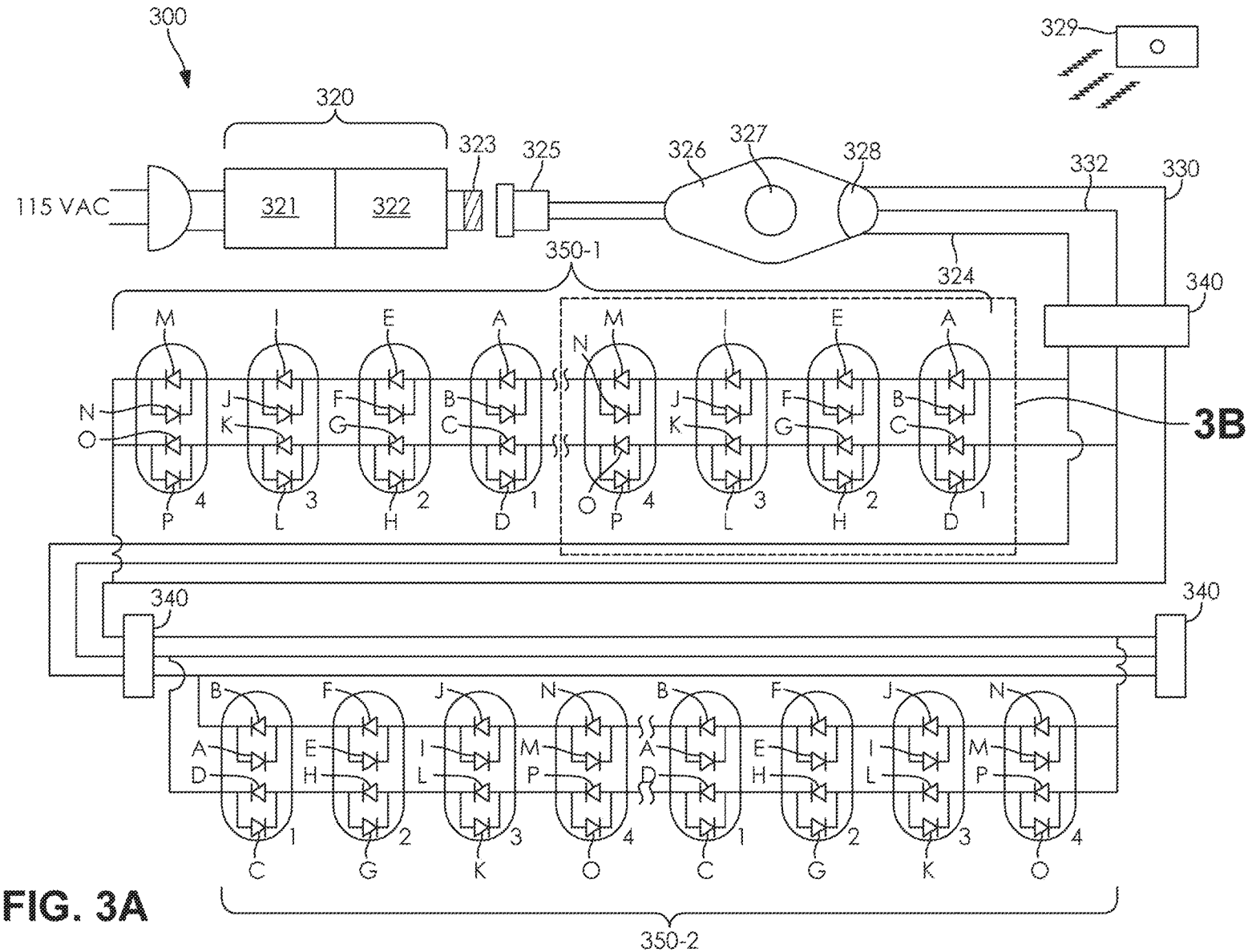
FIG. 3A depicts a circuit diagram of a flat rope light string system according to one embodiment.

Referring initially to FIG. 3A there is shown a flat rope light string system 300 including a controller 326, a high-to-low voltage conversion and rectification module 320, and light strings 350-1 and 350-2. The high-to-low voltage conversion and rectification module 320 is shown separated into two separate and discrete modules, 321, 322. A voltage conversion module 123 performs a high-to-low voltage conversion function and a rectification module 124 performs a rectification function. The high-to-low voltage conversion and rectification module 321 is connected at a first connection point to a high voltage power source 324, such as a typical 115V AC power source as found in a residence or a building. Connection 324 may be either polarized, meaning that it has only one connection orientation or un-polarized. The high-to-low voltage conversion and rectification module 322 may be composed of any known or heretofore developed commercial voltage converters such as those provided by power converters, power inverters, power adaptors or power transformers. The high-to-low voltage conversion and rectification module 322 is connected at a second connection point to a controller 326 including a manual switch 327 and a wireless receiver/transmitter head 328. Controller 326 provides various switching functions to control the various LED light strings 350-1 and 350-2.

The flat rope light string system 300 includes two LED light strings 350-1 and 350-2, where each string set comprises eight LED bub housings 353. Each LED light string 350-1 and 350-2 is wired in parallel between electrical connectors {324 and common 330} and {332 and common 330}. The LED light strings sets 350-1 and 350-2 are coupled together via a harness 340. Harnesses 340 may be comprised of any of the standard male-female mating systems typically used for making electrical connections for light strings. Further, harnesses 340 may be polarized so that only one connection orientation is possible in making the mating connection between the two light strings.

Each LED bulb housing 353 of LED light string sets 350-1 and 350-2 is comprised of 2 pairs of dual color LEDs, for a total of four LEDs per bulb housing 353. For example, LED bulb housing 1 of each string set 350-1 and 350-2 is comprised of two LED pairs. For example, in one bulb housing 353 there is shown a first LED pair (A,B) and a second LED pair (C,D). Each of the LEDs in the respective LED pairs having a back-to-back configuration, as described above.

Although the physical construction and electrical circuit layout of FIG. 3A have been specifically disclosed, those of skill in the art will appreciate that alternative physical constructions and electrical arrangements may exist to accomplish the above-described functions without departing from the teaching of the present invention.

Figures 3B, 3C:
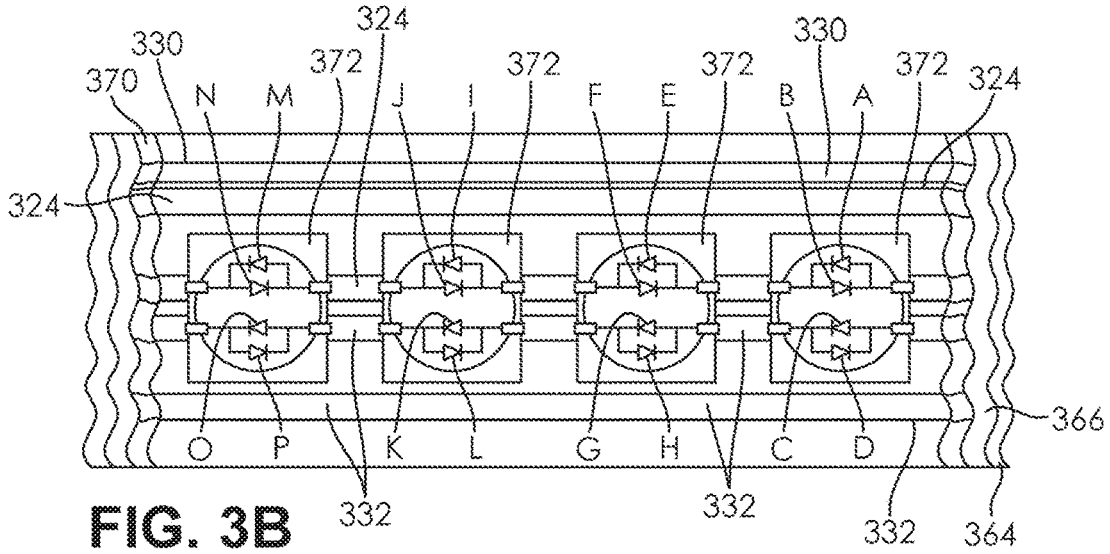
FIG. 3B depicts a top down partial cut-away view of a plurality of interconnected LED bulb housings of a flat rope light string system according to the embodiment of FIG. 3A.
FIG. 3C depicts a depicts a chart illustrating the color assignments/pairings displayed by the LED light elements of the flat rope light string system of FIG. 3A.

FIG. 3C is a color assignment/pairings chart describing the bulb color assignments and bulb color pairings in the LED bulb housings in the light strings 350-1 and 350-2. Referring to the first and second rows of the chart, as reproduced in Table III below, there is shown LEDs "A" and "B", which are paired, pre-selected as "White/Yellow". Color selection, placement and pairings of the LEDs at the time of manufacture provides the means for displaying colors associated with the various holidays and events, as shown in the color output chart of FIG. 3D.

TABLE III

| ROW | LED ID | BULB ID | BULB COLOR | COLOR PAIRINGS |
|---|---|---|---|---|
| 1 | A | BULB 1 | WHITE | WHITE/YELLOW |
| 2 | B | BULB 1 | YELLOW | WHITE/YELLOW |

With reference now to FIG. 3D, there is shown the resulting illumination states of the light strings 350-1 and 350-2 of the circuit of FIG. 3A, as the circuit is cycled through its various energized states of operation.

In operation, AC electrical power (e.g. 115 VAC) is provided to the HI/LO-AC/DC adapter 320. With push button switch 327 positioned to select a first switch position, a positive polarity DC voltage (+) is conducted through the LED light strings 350-1 and 350-2, coupled across connectors 324 and 330 (common). Each positively biased LED within each of the four bulb housings of LED light strings 350-1 and 350-2, coupled in parallel to connectors 324 and 330, will be simultaneously illuminated in this first switch position. For example, in the first switch position positively biased LEDs (A, E, I, M) of bulb housings 1-4 in each of LED light string 350-1 and 350-2 will be positively biased and will be illuminated in accordance with the positive polarity DC voltage (+).

Depressing push button switch 327 a second time results in the selection of a negative polarity DC voltage (−) conducted through the LED light strings 350-1 and 350-2, coupled across connectors 324 and 330. Each negatively biased LED coupled across connectors 324 and 330 within each bulb housing will be illuminated in this second switch position. For example, LEDs (B, F, J, N) will be negatively biased in this second switch position and will be illuminated in accordance with the negative polarity DC voltage (−).

Depressing push button switch 327 a third time results in the selection of a positive polarity DC voltage (+) conducted through the LED light strings 350-1 and 350-2, coupled across the connectors 322 and 330. Each positively biased LED within each bulb housing coupled to connectors 322 and 330 will be illuminated in this third switch position. For example, LEDs (C, G, K, O) will be positively biased and will be illuminated in accordance with the positive polarity DC voltage (+).

Depressing push button switch 327 a fourth time results in the selection of the positive polarity DC voltage (+) conducted through the LED light strings 350-1 and 350-2, coupled across connectors 322 and 330. Each positively biased LED coupled across connectors 322 and 330 within each bulb housing coupled to connectors 322 and 330 will be illuminated in this fourth switch position. For example, LEDs (D, H, L, P) will be illuminated in this fourth switch position.

Depressing push button switch 327 a fifth time results in the selection of 120 Hz AC input power. In this fifth switch setting, both sets of LEDs (A, E, I, M) and (B, F, J, N) will light alternately as biased across connectors 324 and 330, by the appropriate phase of the AC power cycle at a rate of 120 Hz. In other words, the 120 Hz AC input power simultaneously provides two different DC power components, having two different phases, to the respective sets of LEDs so that both sets of LEDs appear to illuminate simultaneously. In a practical application, the "flicker" that is taking place electrically through the alternation of the phases is likely to be imperceptible to the human eye and the light strings 350-1 and 350-2 will have the appearance of having all the LEDs, (A, E, I, M) and (B, F, J, N), on simultaneously.

Depressing push button switch 327 a sixth time results in the selection of 60 20 Hz AC input power. In this sixth switch setting, both sets of LEDs (A, E, I, M) and (B, F, J, N) will light alternately as biased across connectors 324 and 330, by the appropriate phase of the AC power cycle at a rate of less than 60 Hz, typically but not exclusively 20 Hz. In other words, the 20 Hz AC input power alternating provides two different DC current directions having two different phases, to the respective sets of LEDs so that both sets of LEDs appear to illuminate alternatingly. This is simple no power components simply positive and negative being replaced to reverse the polarity and illuminate the other LED in the back-to-back pair. In a practical application, the positive current direction is on for 1 to 2 seconds, followed by the negative current direction being on for 1 to 2 seconds in the light strings 350-1 and 350-2. In this manner, the light strings will have the appearance of having all the LEDs, (A, E, I, M) and (B, F, J, N), on in alternating fashion or flashing on and off.

Alternatively, or in addition, remote control capability may be added for switching the controller 326. Wireless receiver/transmitter head 328 may be included in controller 326 for coordinating wireless communication with remote 329 having its own wireless receiver/transmitter head. A push-button switch on the remote 329 is used to switch the switch position of the controller 326 and wireless signals are exchanged between the receiver/transmitter.

FIG. 3B is a top down view of a circuit layout of the circuit of FIG. 3A. The circuit layout comprises a plurality of LED bulb housings 372, four of which are shown for convenience, the LEDs within the LED bulb housings are arranged in as pairs with 2 LED pairs per housing. All of the LEDs within the light string 350-1 are powered by conductor 324. Conductor 330 is shown and powers further light strings, for example, light string 350-2. The circuit layout further comprises common return 330 and sticky backing layer 364 as the outermost layer. On top of sticky backing layer 364, there is shown insulting substrate layer 366. The entire circuit layout is encapsulated at the uppermost layer with a clear insulator layer 370. A key feature of the circuit layout shown in FIG. 3B is the use of a single layer of foil conductors 324, 330 obviating the need for jumper conductors from the LEDs in the respective LED bulb housings 372 on one layer to conductors 324 and 330 on a different layer.

Referring now to FIGS. 4A-4E, schematic diagrams illustrating a flat rope light string system in accordance with yet another embodiment of the present invention are shown.

Figure 4A:
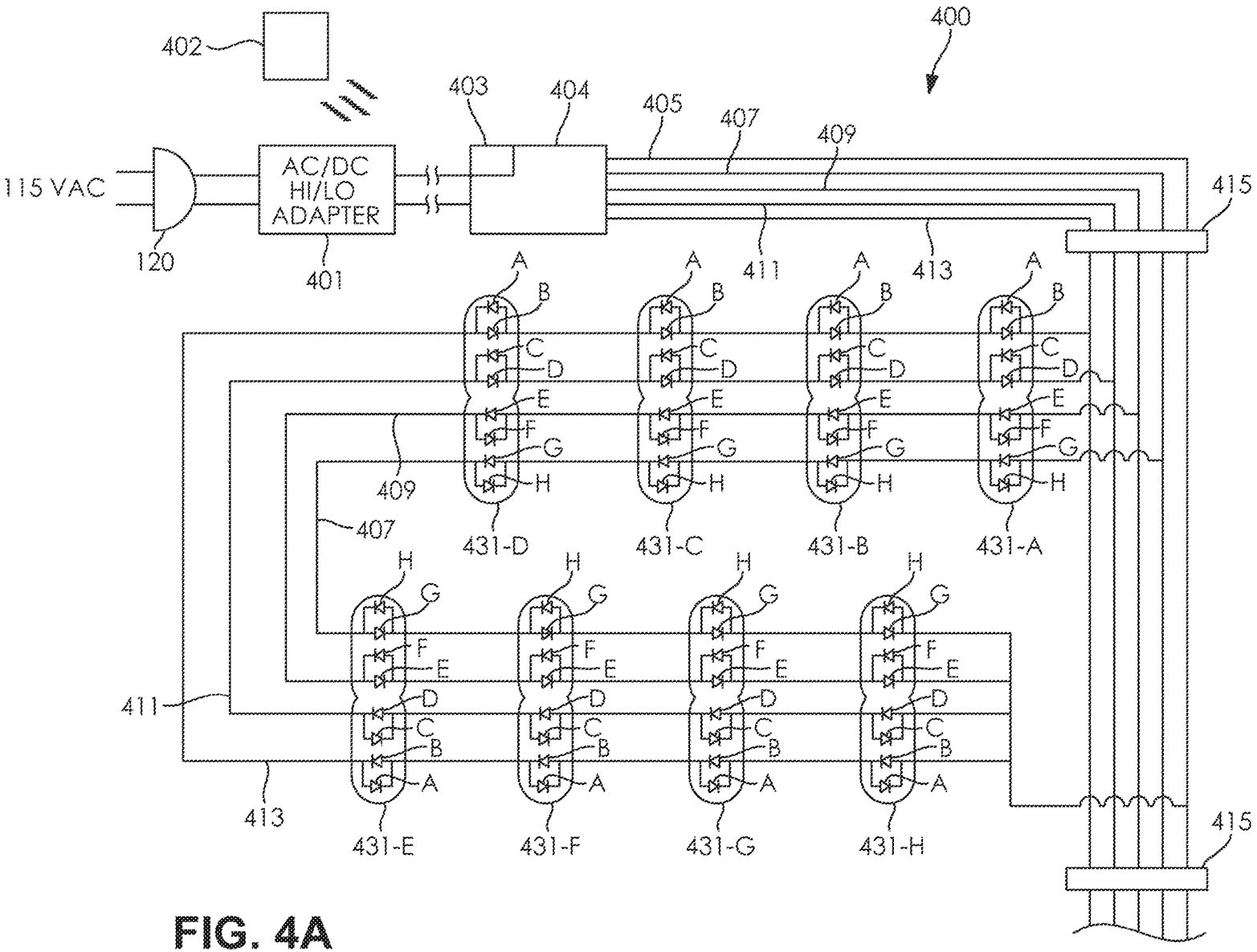
FIG. 4A depicts a circuit diagram of a flat rope light string system according to one embodiment.

FIG. 4A illustrates a flat rope LED system 400 according to a further embodiment of the invention. The flat rope LED system 400 is comprised of eight LED light strings 431-A through 431-H. Each string set is connected in parallel with controller 404. Each LED light string comprises a single bulb housing set is connected in parallel with controller 404. Each LED bulb housing is comprised of eight LEDs configured as four pairs of dual color LEDs, each pair configured in a back-to-back orientation. For example, the first LED light string 431-A is comprised of a single LED bulb housing comprised of four pairs of dual color LEDs, i.e., first LED pair (A,B), second LED pair (C,D), third LED pair (E,F), and fourth LED pair (G,H).

Although the physical construction and electrical circuit layout of FIG. 4A have been specifically disclosed, those of skill in the art will appreciate that alternative physical constructions and electrical arrangements may exist to accomplish the above-described functions without departing from the teaching of the present invention.

Figure 4B:
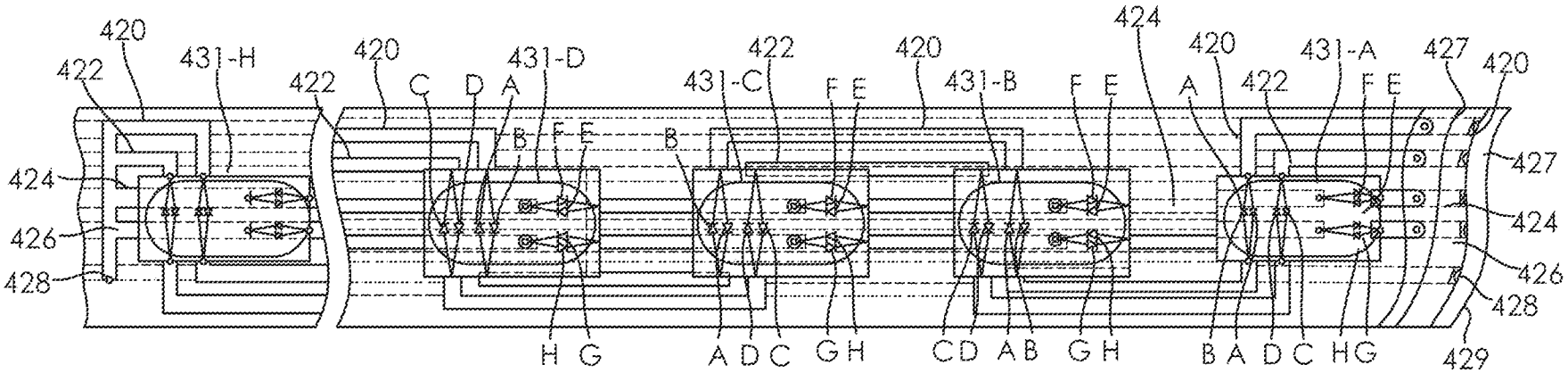
FIGS. 4B & 4C are top and side views of the light elements and sockets according to the embodiment shown in FIG. 4A.
Figure 4C:
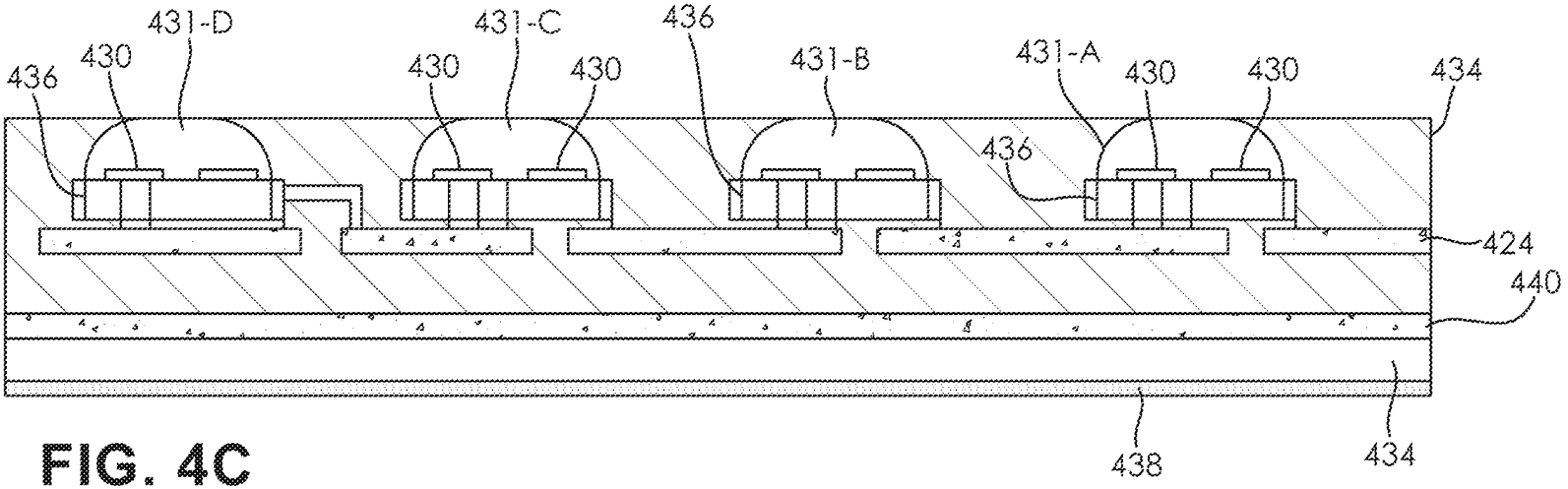

FIG. 4B is a top down view of a circuit layout of FIG. 4A. Single bulb housings 431-A through 431-D and 431-H are shown in detail. However, the description applies to all of the bulb housings 431-A through 431-H. The circuit layout is comprised of two layers. A first layer includes the bulb housings 431-A. A second layer includes 5 foil (power) conductors 420, 422, 424, 424, 426 for powering the bulb housings. Conductor 420 is configured and arranged to power additional (optional) light strings. Each of the foil (power) conductors 420, 422, 424, 426, 420 relies on a single common return 405. The circuit layout further comprises sticky backing layer 429 as the outermost layer. On top of sticky backing layer 429, there is shown insulting substrate layer 427. The entire circuit layout is encapsulated at the uppermost layer with a clear insulator layer 470.

A key feature of the circuit layout shown in FIG. 4B is the use of a single layer of foil (power) conductors 420, 422, 424, 426, 428 obviating the need for jumper conductors from the LEDs in the respective LED bulb housings 431-A through 431-D on one layer to the foil (power) conductors 424, 426, 420 on a different layer, as used in conventional layouts of the prior art.

FIG. 4D is a color assignment/pairings chart describing the bulb color assignments and bulb color pairings in the LED light strings 431-A through 431-H of the present embodiment. Referring to the first and second rows of the chart, there is shown identifying information regarding bulbs "A" and "B" of the LED light string 431-A. Bulbs "A" and "B" are configured in a back-to-back orientation with Bulb "A" being activated (energized) when it is positively biased and Bulb "B" being activated (energized) when it is negatively biased.

TABLE IV

| ROW | LED ID | SET ID | BULB ID | BULB COLOR | COLOR PAIRINGS |
|---|---|---|---|---|---|
| 1 | A | 431-A | BULB 1 | WHITE | WHITE/RED |
| 2 | B | 431-A | BULB 1 | RED | WHITE/RED |

Referring to FIG. 4A, LED "A" is shown paired with LED "B" in the single bulb housing of string set 431-A. LED "A" is factory assigned to be a "white" bulb and LED "B" is factory assigned to be an "orange" bulb.

With reference now to FIG. 4E, which describes certain aspects of the operation of the circuit of FIG. 4A, in operation, AC electrical power is provided to the high voltage power source (e.g., 115 VAC). With controller 404 programmed to select a first switch position, a positive polarity DC voltage (+) is conducted in series, through the respective bulb housings of LED light strings 431-A through 431-H, coupled across connectors 413 and connector (common) 405. Each positively biased LED within each bulb housing connected to connector 413 is activated and will therefore be illuminated in this first switch position. For example, in this first switch position all of the positively biased LEDs labeled "A" will be positively biased (activated) in this first switch position and will be illuminated in accordance with the positive polarity DC voltage (+). The resulting illumination emanating from the respective light strings 431-A through 431-H is "white" corresponding to everyday/Christmas events, as described in the last two columns of FIG. 4E.

Advancing controller 404 to the second switch position, results in the selection of a negative polarity DC voltage (−) conducted in series, through the bulb housings of LED light strings 431-A through 431-H, coupled across connector 413 and common connector 405. Each negatively biased LED coupled across connectors 413 and 405 within each bulb housing 431-A through 431-H is activated and will therefore be illuminated in this second switch position. For example, all of the LEDs labeled "B" will be negatively biased (activated) in this second switch position and will be illuminated in accordance with the negative polarity DC voltage (−). The resulting illumination emanating from the respective light strings 431-A through 431-H in this second switch position is a combination of (red, green, yellow, blue) corresponding to Christmas events, as described in the last two columns of FIG. 4E.

Advancing controller 404 to the third switch position, results in the selection of a positive polarity DC voltage (+) conducted in parallel through the bulb housings of LED light strings 431-A through 431-H coupled across the connector 411 and common connector 405. Each positively biased LED within the single bulb housing of LED string sets 431-A through 431-H coupled to connector 411 and 405 will be activated and therefore illuminated in this third switch position. For example, each LED labeled "C" will be positively biased (activated) and will be illuminated in accordance with the positive polarity DC voltage (+). The resulting illumination emanating from the respective light strings 431-A through 431-H in this third switch position is a combination of (orange, purple, green, purple) corresponding to Christmas events, as described in the last two columns of FIG. 4E.

Advancing controller 404 to the fourth switch position, results in the selection of a negative polarity DC voltage (−) conducted in series through the respective housings, of LED light strings 431-A through 431-H, coupled across connectors 411 and 405. Each negatively biased LED coupled across connectors 411 and 405 within the bulb housings of LED light strings) 431-A through 431-H coupled to connectors 411 and 405 will be activated and therefore illuminated in this fourth switch position. For example, all of the LEDs labeled "D" will be negatively biased (activated) and will be illuminated in accordance with the, negative polarity DC voltage (−). The resulting illumination emanating from the respective bulb housings of LED light strings 431-A through 431-H in this fourth switch position is a combination of (red, white, green, white) corresponding to Christmas events, Italian events, Mexican events, as described in the last two columns of FIG. 4E.

Advancing controller 404 to the fifth switch position, results in the selection of a positive polarity DC voltage (+) conducted in series through the bulb housings of LED light strings 431-A through 431-H, coupled across connectors 409 and 405. Each positively biased LED coupled across the bulb housing of string sets 431-A through 431-H coupled to connectors 409 and 405 will be illuminated in this fifth switch position. For example, each LED labeled "E" will be positively biased (activated) and will be illuminated in accordance with the positive polarity DC voltage (+). The resulting illumination emanating from the respective light strings 431-A through 431-H in this fifth switch position is a combination of (purple, orange, purple, green) corresponding to Mardi Gras events, as described in the last two columns of FIG. 4E.

Advancing controller 404 to the sixth switch position, results in the selection of a negative polarity DC voltage (−) conducted in series through the bulb housings of LED light strings 431-A through 431-H, coupled across connectors 409 and 405. Each negative biased LED coupled across connectors 409 and 405 within the bulb housings of string sets 431-A through 431-H) coupled to connectors 409 and 405 will be illuminated in this sixth position. For example, all of the LEDs labeled "F" will be negatively biased (activated) and will be illuminated in accordance with the negative polarity DC voltage (−). The resulting illumination emanating from the respective light strings 431-A through 431-H in this sixth switch position is a combination of (red, white, red, white) corresponding to Christmas events and Valentine day events, as described in the last two columns of FIG. 4E.

Advancing controller 404 to the seventh switch position, results in the selection of a positive polarity DC voltage (+) conducted in series through the bulb housings of LED light strings 431-A through 431-H, coupled across connectors 407 and 405. Each positively biased LED coupled across connectors 407 and 405 within the bulb housings of string sets 431-A through 431-H) coupled to connectors 407 and 405 will be illuminated in this sixth position. For example, all of the LEDs labeled "G" will be positively biased (activated) and will be illuminated in accordance with the positively polarity DC voltage (+). The resulting illumination emanating from the respective light strings 431-A through 431-H in this sixth switch position is a combination of (red, white, blue, white) corresponding to National events, as described in the last two columns of FIG. 4E.

Advancing controller 404 to the eighth switch position, results in the selection of a negative polarity DC voltage (−) conducted in series through the bulb housings of LED light strings 431-A through 431-H, coupled across connectors 407 and 405. Each negative biased LED coupled across connectors 407 and 405 within the bulb housings of string sets 431-A through 431-H coupled to connectors 407 and 405 will be illuminated in this eighth position. For example, all of the LEDs labeled "H" will be negatively biased (activated) and will be illuminated in accordance with the negative polarity DC voltage (−). The resulting illumination emanating from the respective light strings 431-A through 431-H in this eighth switch position is a combination of (green, red) corresponding to Christmas events, as described in the last two columns of FIG. 4E.

Advancing controller 404 to the ninth switch position, results in the selection of an alternating 120 Hz voltage input that alternates between a positive polarity DC voltage (+) and a negative polarity DC voltage (−) conducted through the LED light strings 431-A through 431-H across connectors 413 and 405. Each positively and negatively biased LED coupled across connectors 413 and 405 within the bulb housings of string sets 431-A through 431-H will be alternately illuminated (activated) in this ninth switch position. For example, each LED labeled "A" all of the LEDs labeled "B" will be alternately illuminated in this ninth switch position. The resulting illumination emanating from the respective light strings 431-A through 431-H in this ninth switch position is a combination of (pink, light green, light green, light yellow, light blue).

What is claimed is:

1. A lighting system comprising:

a controller coupled to a power source at a first connection and at least one flat rope light string at a second connection, said second connection including a plurality of connection leads, said second connection being polarized such that said at least one flat rope light string is capable of one connection orientation at said second connection, said at least one flat rope light string including a plurality of lighting elements, each of said plurality of lighting elements including a plurality of pairs of different colored lights, each of said plurality of pairs including a first light and a second light, said first light of said light pair activated via a first voltage polarity and said second light of said light pair activated via a second voltage polarity, said controller having a switch with a plurality of switch positions including:

a first switch position for providing electrical power at said second connection to said at least one flat rope light string by applying said first voltage polarity on a first connection lead, said first voltage polarity biasing said first light in each of said plurality of pairs of different colored lights within each of said plurality of lighting elements;

a second switch position for providing electrical power at said second connection to said at least one flat rope light string by applying said second voltage polarity on said first connection lead, said second voltage polarity biasing said second light in each of said plurality of pairs of different colored lights within each of said plurality of lighting elements;

a third switch position for providing electrical power at said second connection to said at least one flat rope light string by applying said first voltage polarity on a second connection lead, said first voltage polarity biasing said first light in each of said plurality of pairs of different colored lights within each of said plurality of lighting elements; and a fourth switch position for providing electrical power at said second connection to said at least one flat rope light string by applying said second voltage polarity on said second connection lead, said second voltage polarity biasing said second light in each of said plurality of pairs of different colored lights within each of said plurality of lighting elements.

2. The system of claim 1 wherein said plurality of different colored lights are multicolored LEDs and said lighting element is a bulb containing said multicolored LEDs.

3. The system of claim 1 further comprising:

a voltage conversion module for converting a high voltage AC electric power source to a low voltage AC electric power source; and a rectifier for accepting an input electrical power source to provide an output DC electrical power to the at least one flat rope light string.

4. A lighting system comprising:

a controller coupled to a power source at a first connection and at least one flat rope light string at a second connection, said second connection including three connection leads, said second connection being polarized such that said at least one flat rope light string is capable of only one connection orientation at said second connection, said at least one flat rope light string including a plurality of lighting elements, each of said lighting elements including three pairs of different colored lights, each of said three pairs including a first light and a second light, said first light of said light pair activated via a first voltage polarity and said second light of said light pair activated via a second voltage polarity, said controller having a switch with a plurality of switch positions including:

a first switch position for providing electrical power at said second connection to said at least one flat rope light string by applying said first voltage polarity on a first connection lead, said first voltage polarity biasing said first light in each of said three pairs of different colored lights within each of said plurality of lighting elements;

a second switch position for providing electrical power at said second connection to said at least one flat rope light string by applying said second voltage polarity on said first connection lead, said second voltage polarity biasing said second light in each of said three pairs of different colored lights within each of said plurality of lighting elements;

a third switch position for providing electrical power at said second connection to said at least one flat rope light string by applying said first voltage polarity on a second connection lead, said first voltage polarity biasing said first light in each of said three pairs of different colored lights within each of said plurality of lighting elements;

a fourth switch position for providing electrical power at said second connection to said at least one flat rope light string by applying said second voltage polarity on said second connection lead, said second voltage polarity biasing said second light in each of said three pairs of different colored lights within each of said plurality of lighting elements;

a fifth switch position for providing electrical power at said second connection to said at least one flat rope light string by applying said first voltage polarity on a third connection lead, said first voltage polarity biasing said first light in each of said three pairs of different colored lights within each of said plurality of lighting elements; and a sixth switch position for providing electrical power at said second connection to said at least one flat rope light string by applying said second voltage polarity on said third connection lead, said second voltage polarity biasing said second light in each of said three pairs of different colored lights within each of said plurality of lighting elements.

5. The system of claim 4 wherein said plurality of different colored lights are multicolored LEDs and said lighting element is a bulb containing said multicolored LEDs.

6. The system of claim 4 further comprising:

a seventh switch position for providing electrical power at said second connection to said at least one flat rope light string by simultaneously applying said second voltage polarity on said first, second and third connection leads, said second voltage polarity biasing said second light in each of said three pairs of different colored lights within each of said plurality of lighting elements;

an eighth switch position for providing electrical power at said second connection to said at least one flat rope light string by applying said first voltage polarity on said first and third connection leads, said first voltage polarity biasing said first light in each of said three pairs of different colored lights within each of said plurality of lighting elements;

a ninth switch position for providing electrical power at said second connection to said at least one flat rope light string applying said second voltage polarity on said first and third connection leads, said second voltage polarity biasing said second light in each of said three pairs of different colored lights within each of said plurality of lighting elements;

a tenth switch position for providing electrical power at said second connection to said at least one flat rope light string by alternatingly applying said first voltage polarity on said first connection lead and said second voltage polarity on said third connection lead, said first voltage polarity biasing said first light in each of said of said three pairs of different colored lights within each of said plurality of lighting elements, and said second voltage polarity biasing said second light in each of said pairs of different colored lights within each of said plurality of lighting elements;

an eleventh switch position for providing electrical power at said second connection to said at least one flat rope light string by simultaneously applying:

said second voltage polarity on said first and third connection leads, biasing said first light in each of said three pairs of different colored lights within each of said plurality of lighting elements, and said first voltage polarity on said second connection lead biasing said first light in each of said three pairs of different colored lights within each of said plurality of lighting elements;

a twelfth switch position for providing electrical power at said second connection to said at least one flat rope light string by alternatingly applying:

said first voltage polarity on said first connection lead, biasing said first light in each of said pairs of different colored lights within each of said plurality of lighting elements, said first voltage polarity on said second connection lead biasing said first light in each of said three pairs of different colored lights within each of said plurality of lighting elements, said second voltage polarity on said third connection lead, biasing said second light in each of said three pairs of different colored lights within each of said plurality of lighting elements, and said second voltage polarity on said second connection lead biasing said second light in each of said three pairs of different colored lights within each of said plurality of lighting elements.

7. The system of claim 4 further comprising:

a voltage conversion module for converting a high voltage AC electric power source to a low voltage AC electric power source; and a rectifier for accepting an input electrical power source to provide an output DC electrical power to the at least one flat rope light string.

8. A lighting system comprising:

a controller coupled to a power source at a first connection and at least one flat rope light string at a second connection, said second connection including at least two connection leads, said second connection being polarized such that said at least one flat rope light string is capable of only one connection orientation at said second connection, said flat rope light string containing a plurality of lighting elements, each of said plurality of lighting elements including one or more electrically coupled pairs of different colored lights, each of said one or more electrically coupled pairs including a first light activated via a first voltage polarity and a second light activated via a second voltage polarity, said controller having a switch with a plurality of switch positions including:

a first switch position for providing electrical power at said second connection to said at least one flat rope light string by applying said first voltage polarity on a first connection lead, said first voltage polarity biasing said first light in each of said two electrically coupled pairs of different colored lights within each of said plurality of lighting elements;

a second switch position for providing electrical power at said second connection to said at least one flat rope light string by applying said second voltage polarity on said first connection lead, said first voltage polarity biasing said first light in each of said two electrically coupled pairs of different colored lights within each of said pairs of different colored lights within each of said plurality of lighting elements;

a third switch position for providing electrical power at said second connection to said at least one flat rope light string by applying said first voltage polarity on a second connection lead, said first voltage polarity biasing said first light in each of said two electrically coupled pairs of different colored lights within each of said plurality of lighting elements; and a fourth switch position for providing electrical power at said second connection to said at least one flat rope light string by applying said first voltage polarity on said second connection lead, said first voltage polarity biasing said first light in each of said two electrically coupled pairs of different colored lights within each of said plurality of lighting elements.

9. The system of claim 8 wherein said plurality of different colored lights are multicolored LEDs and said lighting element is a bulb containing said multicolored LEDs.

10. The system of claim 8 further comprising:

a fifth switch position for providing electrical power at said second connection to said at least one flat rope light string by alternatingly applying:

said first voltage polarity on said first connection lead, said first voltage polarity biasing said first light in each of said two electrically coupled pairs of different colored lights within each of said plurality of lighting elements;

said second voltage polarity on said first connection lead, said second voltage polarity biasing said second light in each of said two electrically coupled pairs of different colored lights within each of said plurality of lighting elements; and a sixth switch position for providing electrical power at said second connection to said at least one flat rope light string by alternatingly applying:

said second voltage polarity on said third connection lead, said first voltage polarity biasing said first light in each of said two electrically coupled pairs of different colored lights within each of said plurality of lighting elements; and said second voltage polarity on said third connection lead said first voltage polarity biasing said first light in each of said two electrically coupled pairs of different colored lights within each of said plurality of lighting elements.

11. The system of claim 8 further comprising:

a voltage conversion module for converting a high voltage AC electric power source to a low voltage AC electric power source; and a rectifier for accepting an input electrical power source to provide an output DC electrical power to the at least one flat rope light string.

12. A lighting system comprising:

a controller coupled to a power source at a first connection and at least one flat rope light string at a second connection, said second connection including at least four connection leads, said second connection being polarized such that said at least one flat rope light string is capable of only one connection orientation at said second connection, said flat rope light string containing a plurality of lighting elements, each of said plurality of lighting elements including four electrically coupled pairs of different colored lights, each of said four electrically coupled pairs including a first light activated via a first voltage polarity and a second light activated via a second voltage polarity, said controller having a switch with a plurality of switch positions including:

a first switch position for providing electrical power at said second connection to said at least one flat rope light string by applying said first voltage polarity on a first connection lead, said first voltage polarity biasing said first light in each of said four electrically coupled pairs of different colored lights within each of said plurality of lighting elements;

a second switch position for providing electrical power at said second connection to said at least one flat rope light string by applying said second voltage polarity on said first connection lead, said second voltage polarity biasing said second light in each of said four electrically coupled pairs of different colored lights within each of said plurality of lighting elements;

a third switch position for providing electrical power at said second connection to said at least one flat rope light string by applying said first voltage polarity on a second connection lead, said first voltage polarity biasing said first light in each of said four electrically coupled pairs of different colored lights within each of said plurality of lighting elements;

a fourth switch position for providing electrical power at said second connection to said at least one flat rope light string by applying said second voltage polarity on said second connection lead, said second voltage polarity biasing said second light in each of said four electrically coupled pairs of different colored lights within each of said plurality of lighting elements;

a fifth switch position for providing electrical power at said second connection to said at least one flat rope light string by applying said first voltage polarity on a third connection lead, said first voltage polarity biasing said first light in each of said four electrically coupled pairs of different colored lights within each of said plurality of lighting elements;

a sixth switch position for providing electrical power at said second connection to said at least one flat rope light string by applying said second voltage polarity on said third connection lead, said first voltage polarity biasing said second light in each of said four electrically coupled pairs of different colored lights within each of said plurality of lighting elements;

a seventh switch position for providing electrical power at said second connection to said at least one flat rope light string by applying said second voltage polarity on said fourth connection lead, said second voltage polarity biasing said first light in each of said four electrically coupled pairs of different colored lights within each of said plurality of lighting elements;

an eighth switch position for providing electrical power at said second connection to said at least one flat rope light string by applying said first voltage polarity on said fourth connection lead, said first voltage polarity biasing said first light in each of said four electrically coupled pairs of different colored lights within each of said plurality of lighting elements.

13. The system of claim 12 wherein said plurality of different colored lights are multicolored LEDs and said lighting element is a bulb containing said multicolored LEDs.

14. The system of claim 12 further comprising:

a ninth switch position for providing electrical power at said second connection to said at least one flat rope light string alternatingly applying:

said first voltage polarity on said first connection lead, said first voltage polarity biasing said first light in each of said four electrically coupled pairs of different colored lights within each of said plurality of lighting elements; and said second voltage polarity on said first connection lead, said second voltage polarity biasing said second light in each of said four electrically coupled pairs of different colored lights within each of said plurality of lighting elements.

15. The system of claim 12 further comprising:

a voltage conversion module for converting a high voltage AC electric power source to a low voltage AC electric power source; and a rectifier for accepting an input electrical power source to provide an output DC electrical power to the at least one flat rope light string.

16. A color-changing flat rope light string comprising:

an insulator substrate including a plurality of cavities;

a plurality of light emitting housings having a transparent enclosure, the housings being configured for insertion into the plurality of cavities, the housings being sequentially connected upon insertion to form the flat rope light string, wherein each housing comprises at least one light emitting diode pair as a light emitting source, wherein the at least one light emitting diode pair comprises two diodes electrically coupled in a back-to-back orientation having different colors;

a plurality of power conductors oriented in a single layer in the insulator substrate, wherein a first light emitting diode from among the at least one diode pair in each housing is electrically coupled to a first power conductor from among the plurality of power conductors and wherein a second light emitting diode from among the at least one diode pair in each housing is electrically coupled to a second power conductor from among the plurality of power conductors, wherein the power conductors power the first and second light emitting diodes alternately to make each housing emit lights of various colors;

an insulating substrate layer below the insulator substrate; and a clear insulation layer allowing light generated by the at least one light emitting diode pair to pass through;

wherein a third light emitting diode from among the at least one diode pair in each housing is electrically coupled to a third power conductor from among the plurality of power conductors and wherein a fourth light emitting diode from among the at least one diode pair in each housing is electrically coupled to a fourth power conductor from among the plurality of power conductors.

17. The flat rope light string of claim 16, wherein those LEDs coupled to the first power conductor are configured to illuminate with the application of a positive DC voltage.

18. The flat rope light string of claim 16, wherein those LEDs coupled to the second power conductor are configured to illuminate with the application of a negative DC voltage.

* * * * *